US010165843B2

(12) United States Patent
Hedges

(10) Patent No.: US 10,165,843 B2
(45) Date of Patent: Jan. 1, 2019

(54) HAND HELD APPLIANCE

(71) Applicant: Dyson Technology Limited, Wiltshire (GB)

(72) Inventor: Christopher William Hedges, Guildford (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 277 days.

(21) Appl. No.: 15/102,712

(22) PCT Filed: Nov. 19, 2014

(86) PCT No.: PCT/GB2014/053408

§ 371 (c)(1),
(2) Date: Jun. 8, 2016

(87) PCT Pub. No.: WO2015/087040

PCT Pub. Date: Jun. 18, 2015

(65) Prior Publication Data

US 2016/0309874 A1 Oct. 27, 2016

(30) Foreign Application Priority Data

Dec. 10, 2013 (GB) ..... 1321812.8
Dec. 10, 2013 (GB) ..... 1321813.6
Dec. 10, 2013 (GB) ..... 1321814.4

(51) Int. Cl.
*A45D 20/12* (2006.01)

(52) U.S. Cl.
CPC ..... *A45D 20/12* (2013.01); *A45D 20/122* (2013.01)

(58) Field of Classification Search
CPC ..... A45D 20/12; A45D 20/122
(Continued)

(56) References Cited

U.S. PATENT DOCUMENTS 1,821,525 A 9/1931 Nielsen
3,352,274 A 11/1967 Calkins
(Continued)

FOREIGN PATENT DOCUMENTS

DE 27 27 940 12/1977
DE 42 36 036 4/1994
(Continued)

OTHER PUBLICATIONS

Search Report dated May 22, 2014, directed to GB Application No. 1321812.8; 2 pages.
(Continued)

*Primary Examiner* — Stephen M Gravini
(74) *Attorney, Agent, or Firm* — Morrison & Foerster LLP

(57) ABSTRACT

A hand held appliance including a body, a handle, a fluid flow path flowing from a fluid inlet into the handle to a fluid outlet from the body and a baffle wherein the fluid flow path is non-linear and the baffle directs flow within the fluid flow path. The fluid flow path may flow in a first direction within the handle and a second direction within the body. The baffle may be provided to direct flow between the handle and the body. The baffle may extend from the handle into a space defined within the body. The handle may include a wall that defines the fluid flow path within the handle. The baffle may form a partial continuation of the wall. The body and the handle may be molded as a first part and a second part. The baffle may be formed from a handle part and a body part.

15 Claims, 21 Drawing Sheets

(58) Field of Classification Search
USPC ..... 34/96–100
See application file for complete search history.

(56) References Cited

U.S. PATENT DOCUMENTS

| | | | | |
|---|---|---|---|---|
| 3,811,208 | A | 5/1974 | Vieceli et al. | |
| 3,939,850 | A | 2/1976 | Wahl | |
| 3,950,052 | A | 4/1976 | Walter et al. | |
| 3,981,314 | A | 9/1976 | Barradas | |
| 4,114,022 | A | 9/1978 | Braulke, III | |
| 4,122,329 | A | 10/1978 | Godel | |
| 4,469,934 | A | 9/1984 | Isshiki et al. | |
| 4,520,256 | A | 5/1985 | Doyle | |
| 4,948,946 | A | 8/1990 | Fukunaga | |
| 5,195,164 | A | 3/1993 | Lambert | |
| 5,546,674 | A | 8/1996 | Lange et al. | |
| 5,875,562 | A * | 3/1999 | Fogarty | A45D 20/10 34/97 |
| 6,148,537 | A * | 11/2000 | Altamore | A45D 20/10 34/97 |
| 7,047,660 | B2 * | 5/2006 | Leventhal | A45D 20/122 34/97 |
| 8,893,400 | B2 * | 11/2014 | Carme | A45D 20/42 132/115 |
| 9,144,286 | B2 * | 9/2015 | Courtney | A45D 20/00 |
| 9,808,065 | B2 * | 11/2017 | Moloney | A45D 20/08 |
| 9,808,066 | B2 * | 11/2017 | Moloney | A45D 20/10 |
| 9,808,067 | B2 * | 11/2017 | Sutter | A45D 20/10 |
| 2004/0166454 | A1 | 8/2004 | Zwicker | |
| 2007/0251539 | A1 | 11/2007 | Tackett et al. | |
| 2011/0079239 | A1 | 4/2011 | Hall | |
| 2011/0233172 | A1 | 9/2011 | Sato et al. | |
| 2012/0278850 | A1 | 11/2012 | Lee | |
| 2013/0111777 | A1 | 5/2013 | Jeong | |
| 2015/0157106 | A1 | 6/2015 | Atkinson | |
| 2015/0157107 | A1 | 6/2015 | Gosnay et al. | |
| 2016/0309874 | A1 * | 10/2016 | Hedges | A45D 20/12 |
| 2016/0338466 | A1 * | 11/2016 | Atkinson | A45D 20/10 |

FOREIGN PATENT DOCUMENTS

| | | |
|---|---|---|
| EP | 0 240 653 | 10/1987 |
| GB | 2 097 669 | 11/1982 |
| GB | 2 295 006 | 5/1996 |
| GB | 2482548 | 2/2012 |
| GB | 2500798 | 10/2013 |
| JP | 42-17299 | 10/1967 |
| JP | 53-67556 | 6/1978 |
| JP | 55-70004 | 5/1980 |
| JP | 56-28707 | 3/1981 |
| JP | 56-67556 | 6/1981 |
| JP | 59-82404 | 6/1984 |
| JP | 60-249907 | 12/1985 |
| JP | 63-48527 | 9/1988 |
| JP | 2-15005 | 1/1990 |
| JP | 5-228012 | 9/1993 |
| JP | 8-275332 | 10/1996 |
| JP | 2003-153731 | 5/2003 |
| JP | 2003-284609 | 10/2003 |
| JP | 2006-320141 | 11/2006 |
| JP | 2006-320161 | 11/2006 |
| WO | WO-2012/034342 | 3/2012 |

OTHER PUBLICATIONS

Search Report dated Jun. 2, 2014, directed to GB Application No. 1321813.6; 1 page.
Search Report dated Jun. 5, 2014, directed to GB Application No. 1321814.4; 1 page.
International Search Report and Written Opinion dated Feb. 19, 2015, directed to International Application No. PCT/GB2014/053408; 7 pages.
Atkinson, U.S. Office Action dated Aug. 4, 2017, directed to U.S. Appl. No. 14/564,888; 11 pages.
Gosnay et al., U.S. Office Action dated Oct. 5, 2017, directed to U.S. Appl. No. 14/564,914; 17 pages.
Atkinson, U.S. Office Action dated Feb. 8, 2017, directed to U.S. Appl. No. 14/564,888; 16 pages.
Gosnay et al., U.S. Office Action dated Apr. 4, 2017, directed to U.S. Appl. No. 14/564,914; 21 pages.
Gosnay et al., U.S. Office Action dated Mar. 30, 2018, directed to U.S. Appl. No. 14/564,914; 15 pages.

* cited by examiner

HAND HELD APPLIANCE

REFERENCE TO RELATED APPLICATIONS

This application is a national stage application under 35 USC 371 of International Application No. PCT/GB2014/053408, filed Nov. 19, 2014, which claims the priority of United Kingdom Application Nos. 1321812.8, 1321813.6, and 1321814.4, each filed Dec. 10, 2013, the entire contents of which are hereby incorporated by reference.

FIELD OF THE INVENTION

This invention relates to a hand held appliance and in particular a hair care appliance such as a hairdryer.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid intake end of the blower. Conventionally such appliances are provided with a nozzle which can be attached and detached from the appliance and changes the shape and velocity of fluid flow that exits the appliance. Such nozzles can be used to focus the outflow of the appliance or to diffuse the outflow depending on the requirements of the user at that time.

The fan and heater require power in order to function and this is provided via internal wiring from either a mains power cable or batteries attached to the appliance.

Often the body of the appliance is formed from a clam shell of two parts which are joined by gluing along a joint line or an alternative fixing method such as using screws to attach one part of the body to the other part.

SUMMARY OF THE INVENTION

According to a first aspect, the invention provides a device for distributing at least one wire within a housing, the device comprising a central hub and at least one arm extending from the central hub towards the housing and wherein the at least one arm houses the at least one wire.

Preferably, the housing is a tube having a larger diameter than the central hub.

It is preferred that the at least one arm comprises a pair of arms. Preferably, there are two wires and each one of the pair of arms houses a wire. It is preferred that an arm is provided to house each wire, for example if there were four wires, four arms would be provided.

Preferably, the at least one arm is symmetrical. The at least one arm is preferably symmetrical in cross section and/or outline or silhouette. Where more than one arm is provided, each one of the arms is symmetrically spaced around the central hub. Where a pair of arms is provided, preferably each one of the pair of arms is diametrically spaced apart. Preferably, the pair of arms is symmetrical. It is preferred that the pair of arms describes a Y shape.

Preferably, the at least one arm encases and electrically isolates the at least one wire.

It is preferred that the wires are delivered to the housing by a cable. Preferably, the cable is connectable to a power source at a distal end from the housing. Alternatively, the wires extend from an internal power source such as a battery or fuel cell, for example.

Preferably, the central hub houses the cable. It is preferred that the device is moulded from a plastic material. Preferably, the device is formed from a first part and a second part.

It is preferred that the first part and the second part both provide a portion of the at least one arm. This simplifies assembly, as the wires and optional cable can be located with respect to one of the first part and the second part and then retained in this position by the other part when the device is assembled.

Preferably, the first part and the second part both provide a portion of the hub. This also simplifies assembly, as the wires and optional cable can be located with respect to one of the first part and the second part and then retained in this position by the other part when the device is assembled.

It is preferred that the housing is a handle of an appliance.

According to a second aspect, the invention provides a hand held appliance comprising a tube defining a fluid flow path from a fluid inlet into the tube to a fluid outlet from the tube and a device for distributing at least one wire to the tube wherein the device comprises a central hub and at least one arm extending from the central hub towards the tube and wherein the at least one arm houses the at least one wire.

Preferably, the at least one arm extends across the fluid flow path. Preferably, the at least one arm is symmetrical in cross section. Preferably, the at least one arm extends symmetrically with respect to the fluid flow path. Preferably, there are two arms and each arm is symmetrical. When there is more than one arm, the arms are preferably, equally spaced around the central hub. When there is more than one arm each arm is substantially the same in cross section, length and footprint exposed within the fluid flow path. Thus each arm has the same external outline or silhouette. Each of these features reduces turbulence created by the arms within the fluid flow path so minimises pressure losses and noise created.

In a preferred embodiment, there are two wires and the at least one arm comprises two arms, one for housing each wire. Where a pair of arms is provided, it is preferred that the two arms are diametrically spaced apart.

The at least one arm is preferably symmetrical in cross section. Thus, fluid flows evenly around each side of the at least one arm. This prevents the formation of an asymmetric flow around an arm which would create turbulence and noise.

It is preferred that the pair of arms describes a Y shape. This shape has two benefits, the path taken by the wires from the central hub to the tube is curved so there is less chance of kinking of the wires and it provides axial reinforcement against any forces applied to the cable.

It is preferred that the central hub is located in approximately the middle of the tube.

Preferably, the at least one arm extends from the central hub towards the fluid outlet of the tube. In this embodiment, the at least one arm follows the flow of fluid within the fluid flow path.

It is preferred that the at least one arm is shaped to minimise flow disturbance and turbulence created within the fluid flow path. Preferably, the at least one arm has a tapered back face. It is preferred that the tapered back face has a taper of 45° to 0°. Alternatively, the at least one arm has a symmetrical aerofoil cross section. This reduces flow separation and the production of turbulence at the downstream end of the at least one arm.

In a preferred embodiment, the device comprises at least one reinforcing rib extending radially from the central hub towards the tube. Preferably the at least one reinforcing rib extends axially along at least a portion of the tube.

One or more reinforcing rib preferably extends from the at least one arm towards the fluid inlet.

The at least one reinforcing rib increases the hoop strength of the tube and reduces the stresses transferred to the tube when the cable is bent towards the tube.

Preferably, the at least one reinforcing rib is curved towards the fluid inlet of the tube. Whilst the reinforcing rib has the benefit of structurally supporting the tube, it has the counter effect of blocking part of the fluid inlet. In order to minimise any blocking or restriction to fluid entering the fluid inlet the thickness of the rib is reduced towards the inlet. Where a reinforcing rib extends from an arm, the rib is sculpted around the cable.

Preferably, the at least one arm encases and electrically isolates the at least one wire.

It is preferred that the at least one wire is delivered to the housing by a cable. Preferably, the cable is connectable to a power source at a distal end from the housing.

Preferably, the central hub houses the cable.

It is preferred that the device is moulded from a plastic material.

Preferably, the device is formed from a first part and a second part. It is preferred that the first part and the second part both provide a portion of the at least one arm. Preferably, the first part and the second part both provide a portion of the hub.

It is preferred that the tube comprises a wire guide extending at least partially along the tube towards the fluid outlet of the tube.

Preferably, the wire guide isolates the at least one wire from the fluid flow path.

It is preferred that the at least one arm aligns with the wire guide to provide a path for wires from the cable through the device and along the tube.

Preferably, the tube comprises a handle of the appliance.

According to a third aspect the invention provides a hair care appliance comprising a tube defining a fluid flow path from a fluid inlet into the tube to a fluid outlet from the tube and a device for distributing wires to the tube wherein the device comprises a central hub and at least one arm extending from the central hub towards the tube and wherein the at least one arm houses the wires.

Preferably, the tube comprises a handle of the appliance.

According to a fourth aspect the invention provides a hand held appliance comprising a body, a handle having a first end connected to the body and a second end comprising a fluid inlet, a fluid flow path from the fluid inlet through the handle towards the body, a fan unit for drawing fluid along the fluid flow path and a cable extending from the second end of the handle for supplying power to the fan unit wherein at least one wire from the cable is routed along a wall of the handle.

Preferably, the wall of the handle comprises at least one recess extending longitudinally along the handle for accommodating the at least one wire from the cable. In this embodiment, the cable has two wires, so it is preferred that the wall comprises two recesses extending longitudinally along the handle one recess for accommodating each of the two wires from the cable. Preferably, the two recesses are approximately diametrically opposite in the wall.

Preferably, the wall is formed from two half cylinders extending along the handle from the first end. It is preferred that the two half cylinders abut together along a longitudinal edge to form the wall.

Preferably, the at least one wire from the cable is housed within the longitudinal edge.

It is preferred that a first one of the two half cylinders comprises a recess formed within the longitudinal edge and the at least one wire is housed within the recess. Preferably, the first one of the two half cylinders comprises a pair of recesses one disposed along each longitudinal edge of the first one of the two half cylinders. Alternatively, or additionally a second one of the two half cylinders comprises at least one further recess formed within a longitudinal edge. Preferably, the at least one further recess is disposed radially spaced from the recess. Alternatively, the at least one further recess is adjacent the recess when the two half cylinders abut together.

Preferably, the handle comprises an end wall and the cable extends through the end wall. It is preferred that the cable is located approximately centrally within the end wall.

Preferably, the cable is housed within a cable guide. The cable guide is additionally a device for distributing wires within the handle. Preferably, the cable guide surrounds the cable isolating the cable from the fluid flow path.

It is preferred that the cable guide comprises a central cylinder for housing the cable. Preferably, the cable guide further comprises at least one arm for guiding the at least one wire from the cable to the wall.

It is preferred that the at least one arm is shaped to minimise flow disturbance within the fluid flow path.

Preferably, the at least one arm has a tapered back face. Alternatively, the at least one arm has a symmetrical aerofoil cross-section.

It is preferred that the at least one arm extends along the fluid flow path towards the body from the central cylinder to the inner wall. Preferably, the cable guide includes two arms radially spaced around the cable guide one housing a live wire and the other a neutral wire. Preferably, the cable guide is Y-shaped. It is preferred that the cable guide is formed in two parts. Preferably, one part of the cable guide is formed integrally with one of the two half cylinders. It is preferred that a second part of the cable guide is formed integrally with a second of the two half cylinders.

Preferably, the wall of the handle is moulded from a plastic material.

It is preferred that the handle comprises an outer wall which extends around the wall of the handle. Thus, the wall of the handle is an inner wall.

Preferably, the fan unit is provided in the handle of the appliance. It is preferred that the fan unit includes a motor and an impeller.

The at least one wire is retained in a recess for at least some of the length of the handle, the at least one wire may be retained in a recess for substantially the whole length of the handle. Any of the recess, pair of recesses and the at least one further recess extend at least partially along the wall.

Alternatively, the at least one wire is partially retained by a recess and partially retained by a channel. It is preferred that the channel is radially spaced from the longitudinal edge of the two half cylinders. Thus in embodiments where a recess is formed in a longitudinal edge, the channel is radially spaced from the recess. The channel is preferably provided centrally of and extends longitudinally along one of the two half cylinders that the wall of the handle is preferably formed from. The channel is preferably provided within the region of the handle that houses the fan unit. One reason for providing the channel is for ease of assembly of the appliance. Thus, the at least one wire is placed in the channel, the fan unit and housing is positioned within the half cylinder over the at least one wire retaining it in position around the fan unit, the at least one wire is then routed along a recess in the wall towards the cable.

According to a fifth aspect the invention provides a hair care appliance comprising a body, a handle having a first end connected to the body and a second end comprising a fluid inlet, a fluid flow path from the fluid inlet through the handle towards the body, a fan unit for drawing fluid along the fluid flow path and a cable extending from the second end of the handle for supplying power to the fan unit wherein at least one wire from the cable is routed along a wall of the handle.

Preferably, the hair care appliance is a hairdryer or a hot styling brush.

According to a sixth aspect the invention provides a hand held appliance comprising a duct and a switch, the switch comprises a user operable button, electrical contacts and a push rod wherein, the button is housed on an external surface of the duct, the electrical contacts are housed on an internal surface of the duct and the push rod physically connects the button to the electrical contacts.

Preferably, the duct is generally circular and the electrical contacts are housed approximately diametrically opposite the button.

It is preferred that the duct is a handle of the appliance.

Preferably, the duct comprises an inner wall and the electrical contacts are housed on the inner wall. It is preferred that the inner wall defines a fluid flow path through the handle.

Preferably, the switch further comprises a guide rod for guiding the push rod across the duct. It is preferred that the guide rod forms part of an inner wall of the duct and extends at least partially across the duct. Preferably, the guide rod extends radially across the duct. It is preferred that the guide rod is at least partially supported by the electrical contacts. Preferably, the electrical contacts are at least partially embedded in the inner wall of the duct.

It is preferred that the guide rod supports the push rod across the duct.

Preferably, the guide rod extends from the inner wall across a fluid flow path. It is preferred that the guide rod is shaped to mitigate creation of turbulence as fluid flows along the fluid flow path. Preferably, the push rod is generally cylindrical in shape. Preferably, the guide rod comprises an aperture and the push rod extends through the aperture.

It is preferred that the guide rod has a downstream end and an upstream end and the upstream end is rounded. Preferably the guide rod has a downstream end and an upstream end and the downstream end is pointed. The downstream end of the guide rod can be an aerofoil or drafted with a tapered back face to minimise flow separation, turbulence and the creation of noise within the fluid flow path.

According to a seventh aspect, the invention provides a hair care appliance comprising a duct and a switch, the switch comprises a user operable button, electrical contacts and a push rod wherein, the button is housed on an external surface of the duct, the electrical contacts are housed on an internal surface of the duct and the push rod physically connects the button to the electrical contacts.

According to an eighth aspect the invention provides a hair care appliance comprising a body, a handle, a fluid flow path flowing from a fluid inlet into the handle to a fluid outlet from the body and a baffle wherein the fluid flow path is non-linear and the baffle directs flow within the fluid flow path.

Preferably, the fluid flow path flows in a first direction within the handle and a second direction within the body.

It is preferred that the baffle is provided to direct flow between the handle and the body.

It is preferred that the baffle extends from the handle into a space defined within the body.

Preferably, the handle comprises a wall that defines the fluid flow path within the handle. Preferably, the baffle forms a partial continuation of the wall.

It is preferred that the body and the handle are moulded as a first part and a second part. Preferably, the baffle is formed from a handle part and a body part. It is preferred that the handle part of the baffle is moulded as part of the first part. It is preferred that the body part of the baffle is moulded as part of the second part.

Preferably, the body part of the baffle forms a partial continuation of the handle wall within the body.

Preferably, the handle part of the baffle is moulded as part of the first part. It is preferred that the body part of the baffle is moulded as part of the second part.

Preferably, the body comprises an outer wall and the handle comprises a wall each at least partially defining the fluid flow path from the fluid inlet to the fluid outlet.

It is preferred that the first part of the appliance comprises a first portion of the wall of the handle. Preferably, the second part of the appliance comprises the outer wall of the body and a second portion of the wall of the handle. Preferably, when the first par and the second part are assembled a complete handle wall is produced. This handle wall is preferably located upstream of the fluid inlet. It is preferred that the handle comprises an outer wall that surrounds the wall and includes the fluid inlet.

It is preferred that baffle is arcuate. Preferably, the baffle is radially arcuate.

Preferably, the fluid flow path in the body is substantially orthogonal to the fluid flow path in the handle.

It is preferred that the body has an upstream end and a downstream end and the fluid outlet is located at or near the downstream end.

Preferably, the handle is located towards the upstream end of the body.

It is preferred that a printed circuit board (PCB) is provided within the body between the handle and the upstream end of the body. Preferably, the baffle reduces interaction between the fluid flowing from the handle and the PCB.

It is preferred that the baffle includes a slot. Preferably, the PCB comprises a flexible extension that extends from the PCB to a control button located on the handle. It is preferred that the flexible extension passes through the slot in the baffle.

According to a ninth aspect, the invention provides a hand held appliance comprising a body, a handle, a fluid flow path flowing from a fluid inlet into the handle to a fluid outlet from the body and a baffle wherein the fluid flow path is non-linear and the baffle directs flow within the fluid flow path.

A further aspect of the invention provides a hand held appliance comprising a body having an outer wall and an inner bore, the outer wall comprises a first pair of fingers extending from the outer wall, the inner bore comprises a second pair of fingers extending from the inner bore and adapted to interleave with the first pair of fingers when the inner bore is connected to the outer wall.

In this manner two parts of the body of the appliance are mechanically attached by interleaving or interlocking fingers that extend from each part. This provides a positive positioning or one of the parts with respect to the other which has an advantage when the relative locations of the two parts is important for the appliance to function efficiently, effectively and for the desired life of the appliance.

In addition there are no visible attachment means for example a moulded housing for a screw so a simple clean line is produced.

Preferably, the outer wall has a thickness t and the first pair of fingers is formed within the thickness of the outer wall. This has two advantages, firstly there is continuity of the wall thickness so weak points from a change in the cross-sectional area of the wall are minimised. Secondly, moulding of the part is simplified.

It is preferred that the first pair of fingers extends axially along from the outer wall. This again, minimises weakness in this part of the joint as stress raisers are minimised.

Preferably, one of the fingers of the second pair of fingers is sandwiched between the first pair of fingers. It is preferred that one of the fingers of the first pair of fingers is sandwiched between the second pair of fingers. Either and both of these features increase the strength of the joint.

Preferably, the first pair of fingers comprises an external finger and an internal finger wherein the external finger forms part of the external surface of the appliance. The external finger comprises an outer surface and an inner surface separated by the thickness t1 of the external finger and in this embodiment, the outer surface of the external finger forms part of the outer surface of the outer wall. The internal finger also comprises an inner surface and a radially outer surface separated by the thickness t2 of the internal finger. The inner surface of the internal finger preferably forms a part of inner surface of the outer wall.

It is preferred that the external finger extends further than the internal finger. Preferably, the first pair of fingers extends substantially continuously around the outer wall. When the body is generally cylindrical, this means that a joint formed when the first pair of fingers are interleaved with the second pair of fingers extends around the whole of the body.

It is preferred that the inner bore comprises a duct and a side wall and the second pair of fingers extends from the side wall.

Preferably, the second pair of fingers extends substantially continuously around the side wall. It is preferred that the second pair of fingers comprises an inner finger and an outer finger.

Preferably, the side wall is formed from two parts and each part of the side wall comprises a portion of the second pair of fingers. It is preferred that a first part of the side wall comprises the outer finger. Preferably, the first part of the side wall comprises a first portion of the inner finger. It is preferred that the second part of the side wall comprises a second portion of the inner finger.

Preferably, the duct extends within the outer wall when the inner bore is connected to the outer wall. It is preferred that a space between the outer wall and the duct defines a fluid flow path of the appliance. Preferably, the outer wall has a thickness t and the side wall extends across the thickness t of the outer wall. It is preferred that the side wall includes a horn which extends around the side wall and lies adjacent the outer wall forming an extension of the outer wall in the axial direction.

Preferably, the side wall extends at an oblique angle from the outer wall.

It is preferred that the outer wall and the inner bore are visually distinct.

Preferably, the duct defines a further fluid flow path of the appliance.

Preferably, the appliance comprises a handle connected to the body.

It is preferred that the handle comprises a fluid inlet and a fluid flow path extending along the handle from the fluid inlet towards the body.

Preferably, the handle includes a fan unit for drawing fluid into the fluid inlet.

According to a second aspect, the invention provides a hair care appliance comprising a body having an outer wall and an inner bore, the outer wall comprises a first pair of fingers extending from the outer wall, the inner bore comprises a second pair of fingers extending from the inner bore and adapted to interleave with the first pair of fingers when the inner bore is connected to the outer wall.

In this manner two parts of the body of the appliance are mechanically attached by interleaving or interlocking fingers that extend from each part. This provides a positive positioning or one of the parts with respect to the other which has an advantage when the relative locations of the two parts is important for the appliance to function efficiently, effectively and for the desired life of the appliance.

Preferably, the outer wall has a thickness t and the first pair of fingers is formed within the thickness of the outer wall. This has two advantages, firstly there is continuity of the wall thickness so weak points from a change in the cross-sectional area of the wall are minimised. Secondly, moulding of the part is simplified.

It is preferred that the first pair of fingers extends axially along from the outer wall. This again, minimises weakness in this part of the joint as stress raisers are minimised.

Preferably, one of the fingers of the second pair of fingers is sandwiched between the first pair of fingers. It is preferred that one of the fingers of the first pair of fingers is sandwiched between the second pair of fingers. Either and both of these features increase the strength of the joint.

Preferably, the first pair of fingers comprises an external finger and an internal finger wherein the external finger forms part of the external surface of the appliance. The external finger comprises an outer surface and an inner surface separated by the thickness t1 of the external finger and in this embodiment, the outer surface of the external finger forms part of the outer surface of the outer wall. The internal finger also comprises an inner surface and a radially outer surface separated by the thickness t2 of the internal finger. The inner surface of the internal finger preferably forms a part of inner surface of the outer wall.

It is preferred that the external finger extends further than the internal finger. Thus the external finger is longer than the internal finger i.e. the external surface of the outer wall is axially longer than the internal surface of the outer wall.

Preferably, the first pair of fingers extends substantially continuously around the outer wall. When the body is generally cylindrical, this means that a joint formed when the first pair of fingers are interleaved with the second pair of fingers extends around the whole of the body.

It is preferred that the inner bore comprises a duct and a side wall and the second pair of fingers extends from the side wall.

Preferably, the second pair of fingers extends substantially continuously around the side wall. It is preferred that the second pair of fingers comprises an inner finger and an outer finger.

Preferably, the side wall is formed from two parts and each part of the side wall comprises a portion of the second pair of fingers. It is preferred that a first part of the side wall comprises the outer finger. Preferably, the first part of the side wall comprises a first portion of the inner finger. It is preferred that the second part of the side wall comprises a second portion of the inner finger.

Preferably, the duct extends within the outer wall when the inner bore is connected to the outer wall.

It is preferred that a space between the outer wall and the duct defines a fluid flow path of the appliance.

Preferably, the outer wall has a thickness and the side wall extends across the thickness t of the outer wall.

It is preferred that the side wall includes a horn which extends around the side wall and lies adjacent the outer wall forming an extension of the outer wall in the axial direction.

Preferably, the side wall extends at an oblique angle from the outer wall.

It is preferred that the outer wall and the inner bore are visually distinct.

Preferably, the duct defines a further fluid flow path of the appliance.

Preferably, the appliance comprises a handle connected to the body.

It is preferred that the handle comprises a fluid inlet and a fluid flow path extending along the handle from the fluid inlet towards the body.

Preferably, the handle includes a fan unit for drawing fluid into the fluid inlet.

Preferably, the hair care appliance is a hairdryer.

BRIEF DESCRIPTION OF THE DRAWINGS

The invention will now be described by example, with reference to the accompanying figures, of which.

DETAILED DESCRIPTION OF THE INVENTION

Figure 1:
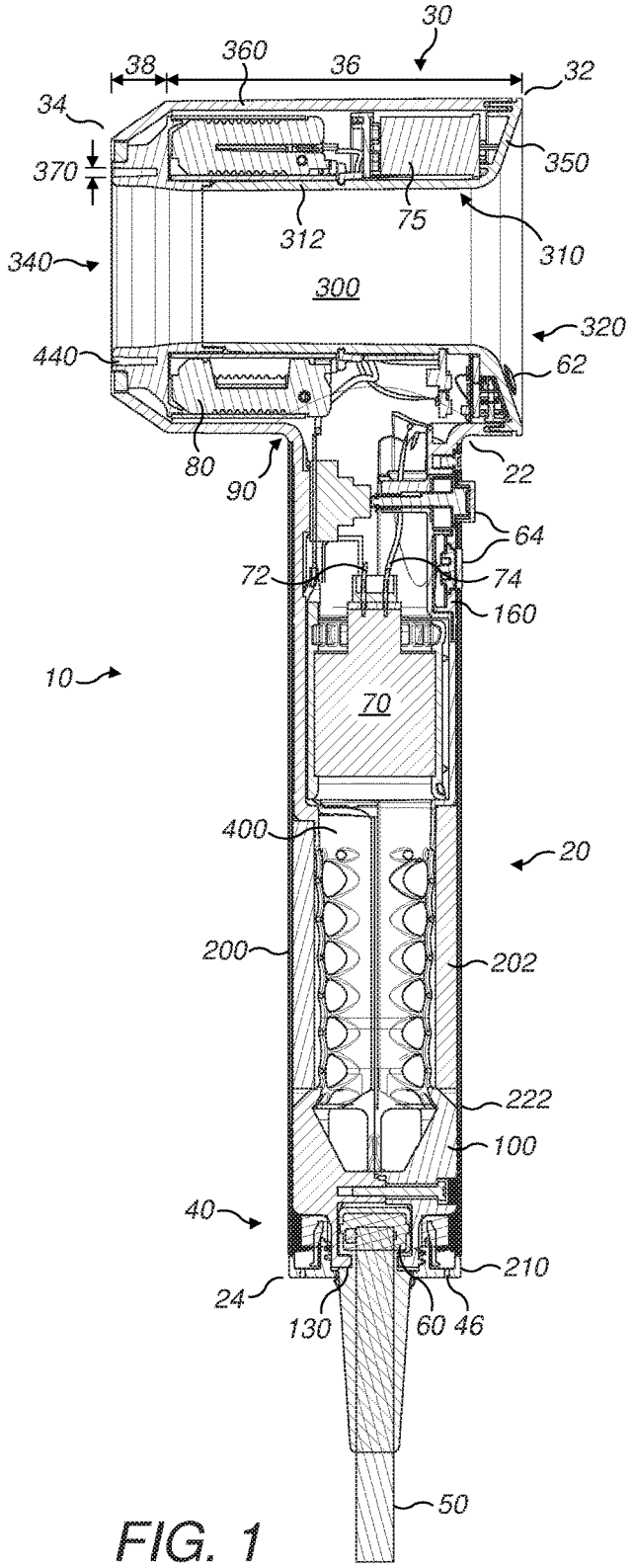
FIG. 1 shows a cross section through an appliance according to the invention.
Figure 2:
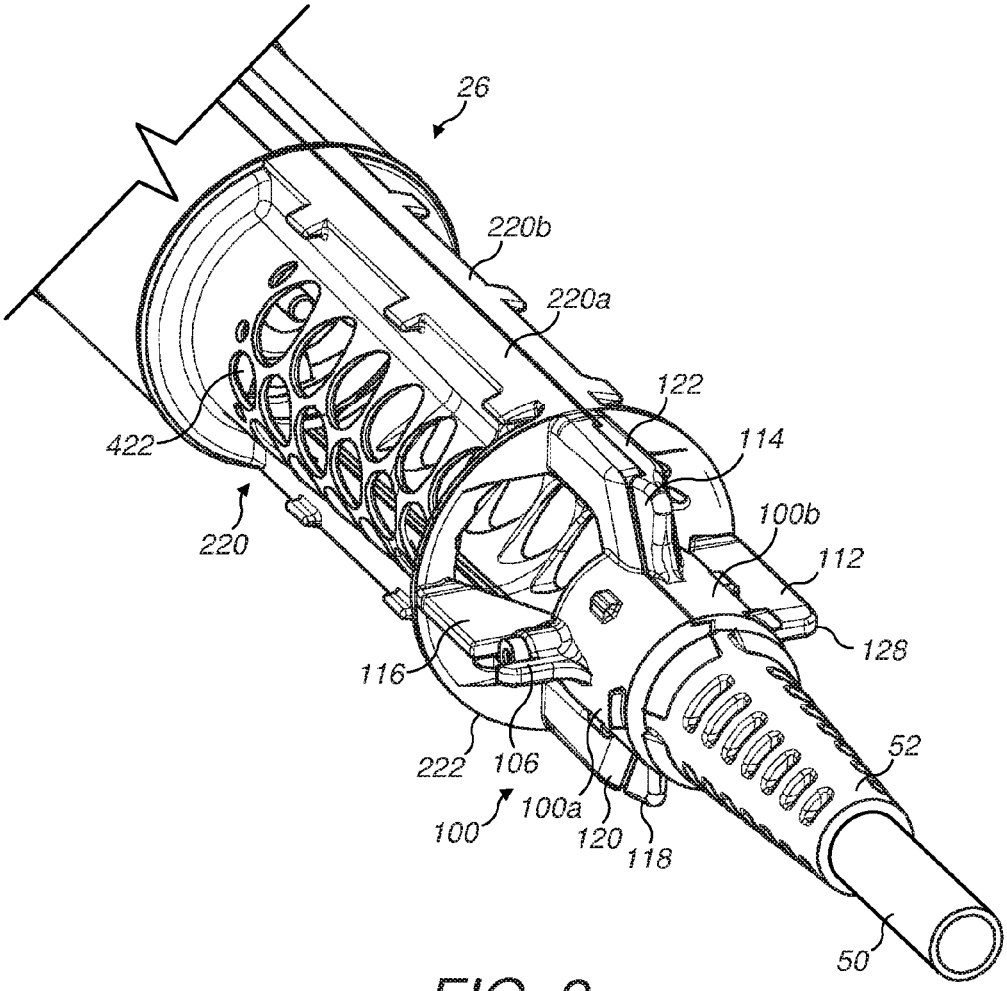
FIG. 2 shows an isometric view of a device according to the invention.
Figure 3:
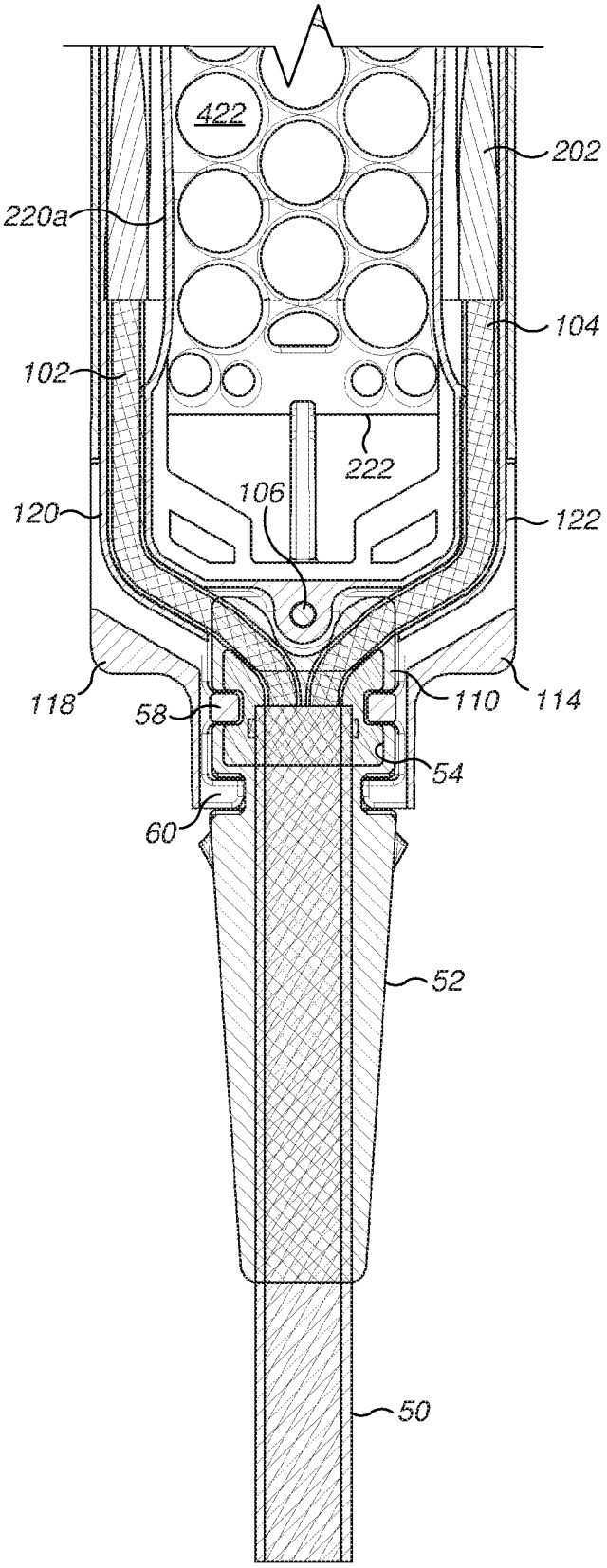
FIG. 3 shows a cross section through the device of FIG. 2.
Figure 4A:
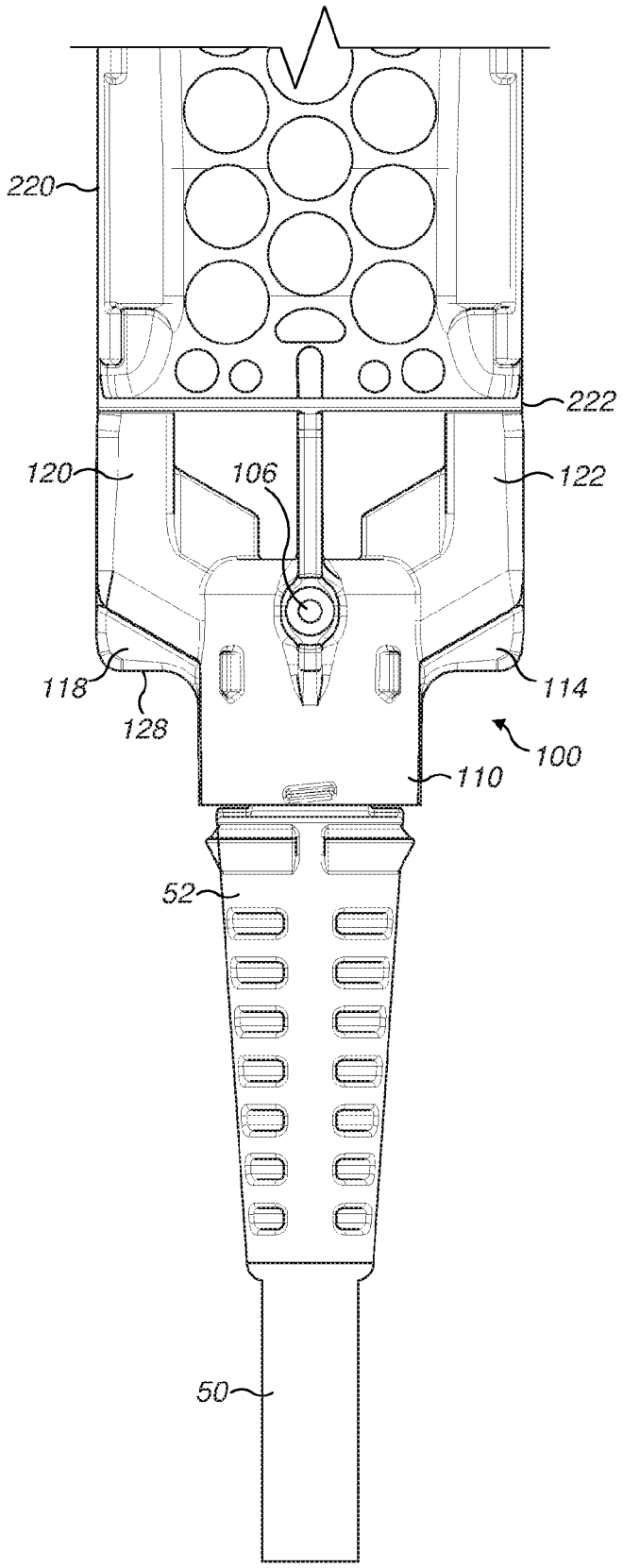
FIG. 4*a* shows a plan view of the device of FIG. 3.
Figure 4B:
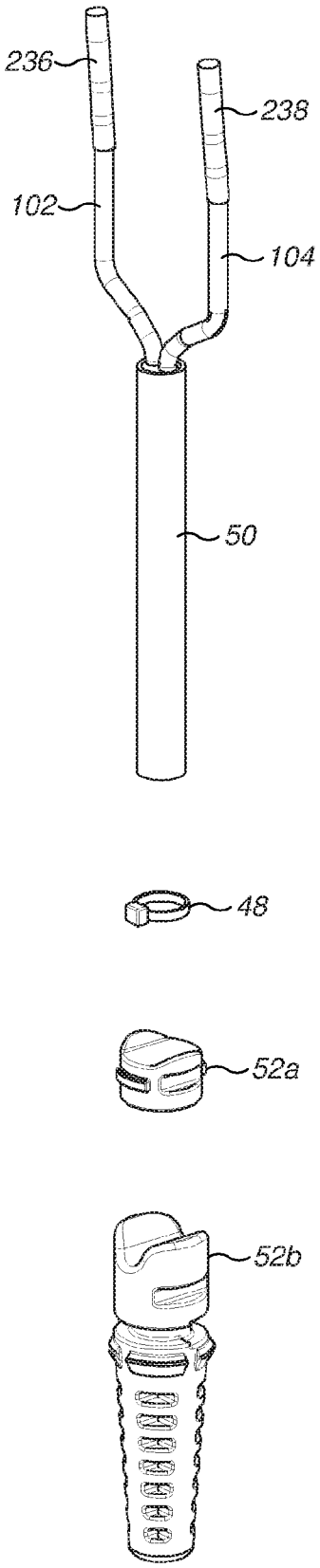
FIG. 4*b* shows the strain relief on the cable in more detail.
Figure 5:
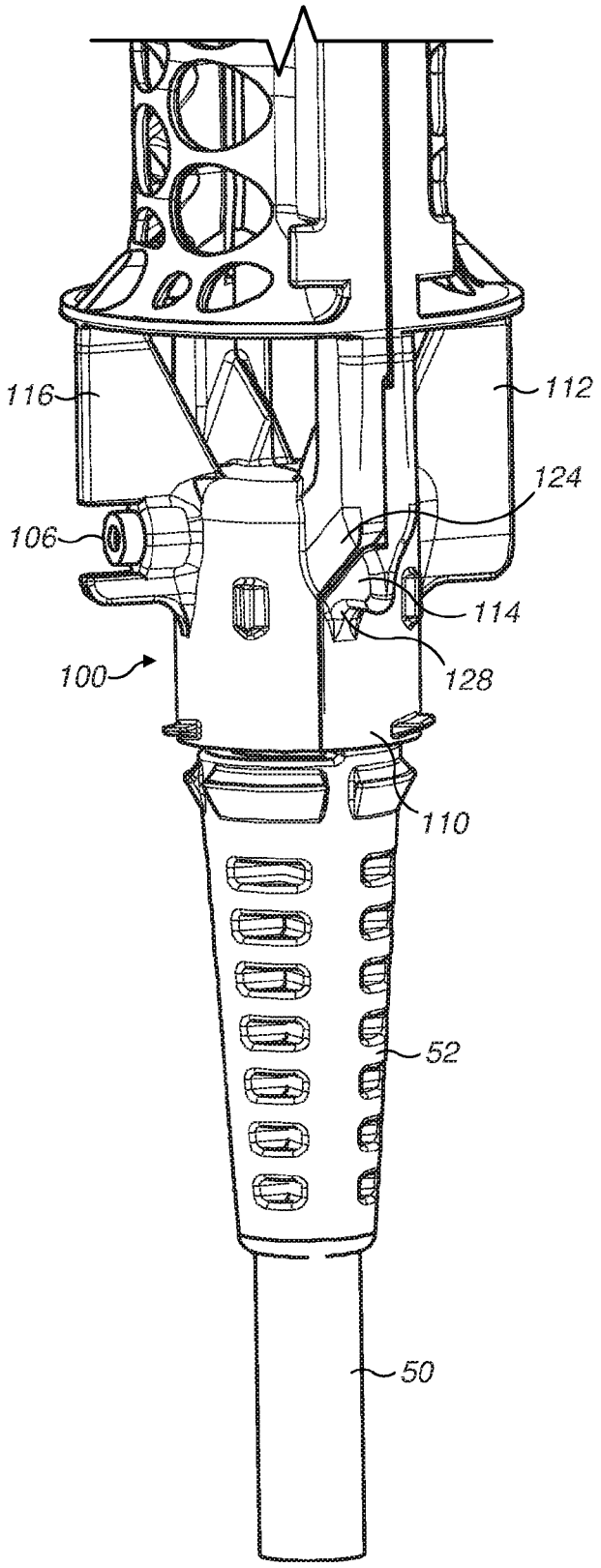
FIG. 5 shows an isometric view of a device according to the invention.
Figure 6:
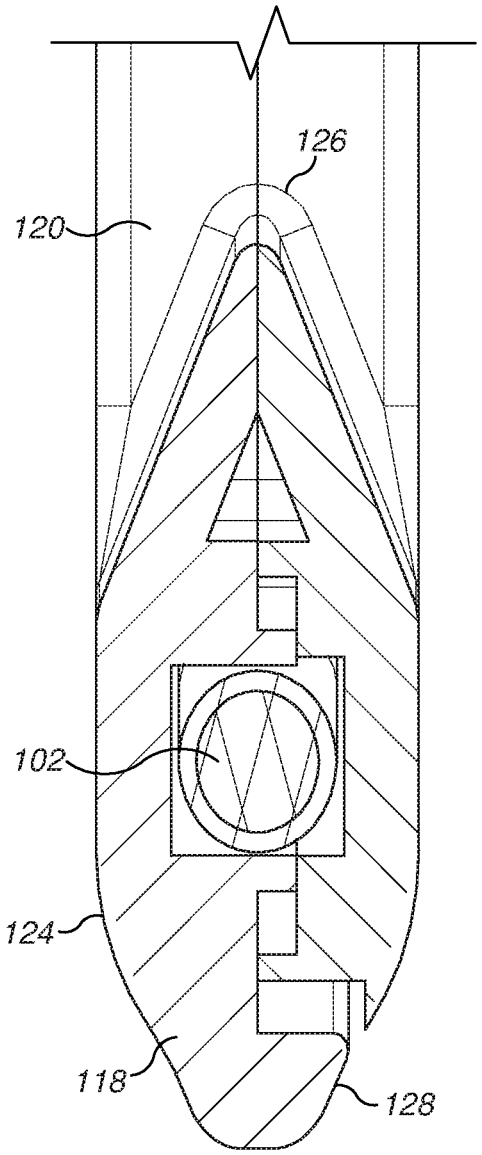
FIG. 6 shows a cross-section through an arm of the device of FIG. 5.
Figure 7B:
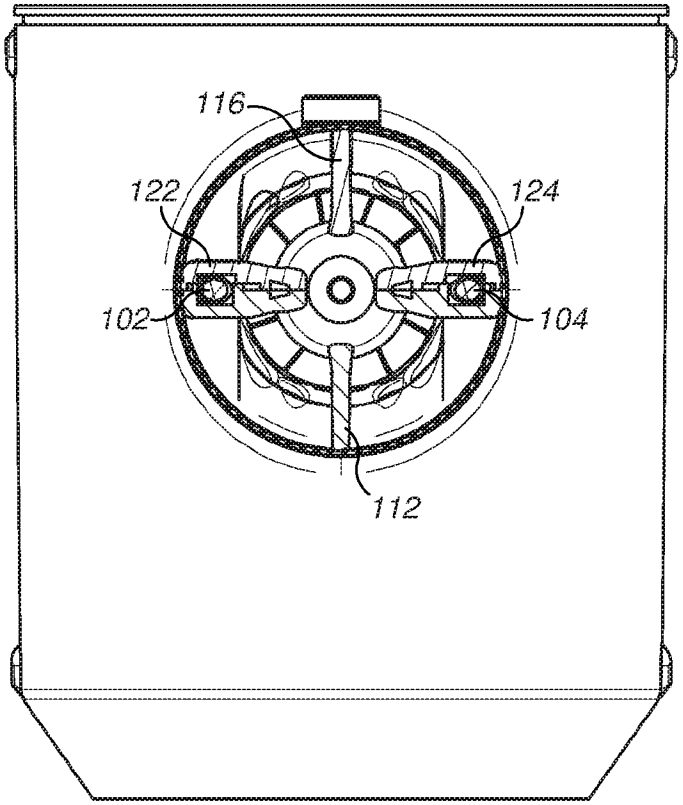
FIG. 7*b* shows a cross section through a device within a handle of an appliance.
Figure 7A:
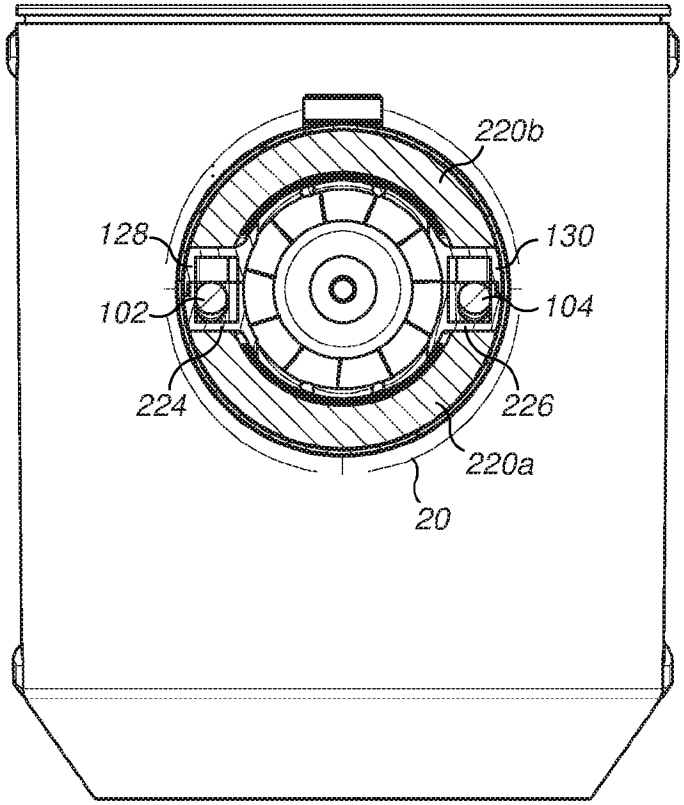
FIG. 7*a* shows a cross section through a handle of an appliance.
Figure 8A:
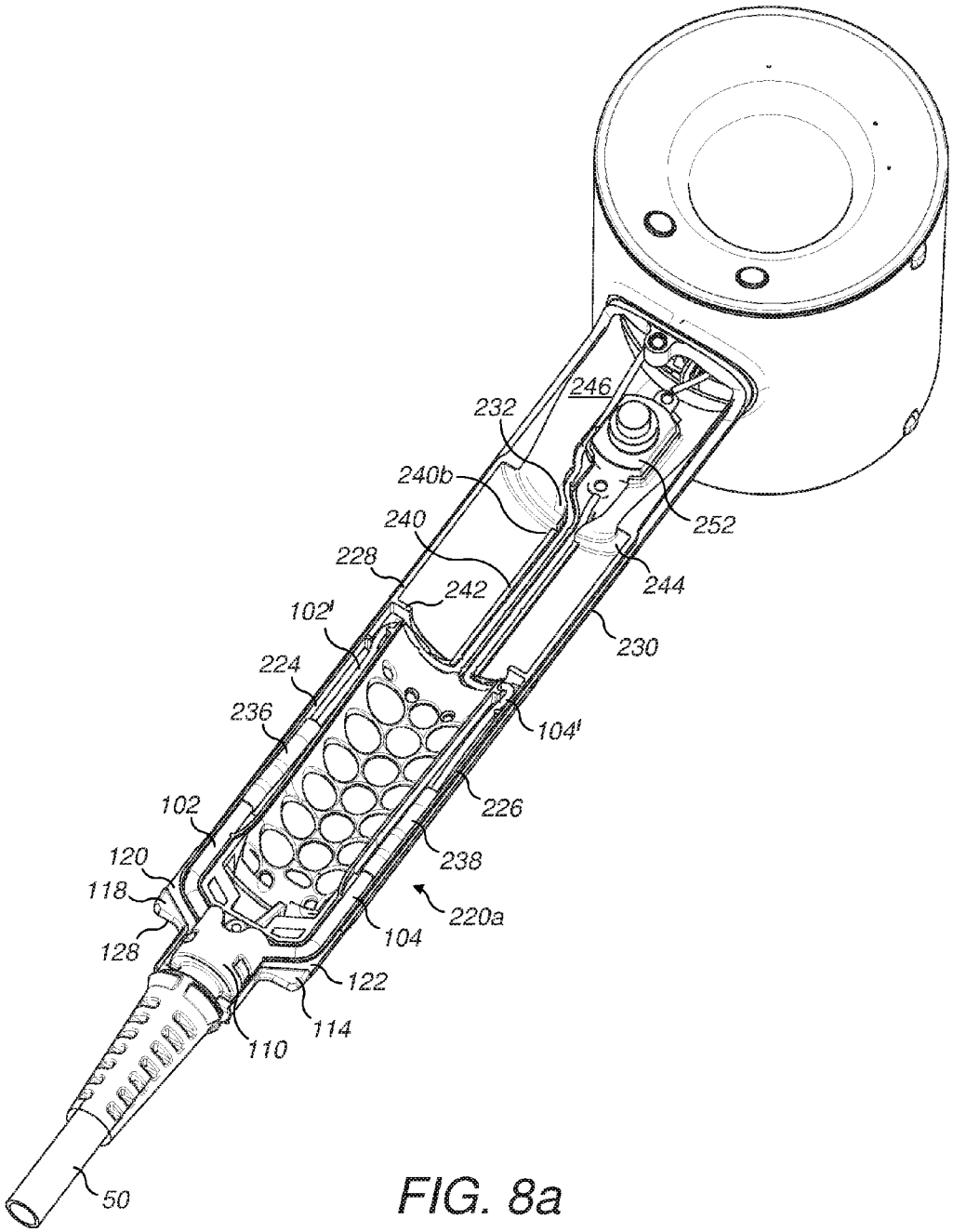
FIGS. 8*a* and 8*b* show different cross sections through the inner wall of a handle of an appliance.
Figure 8B:
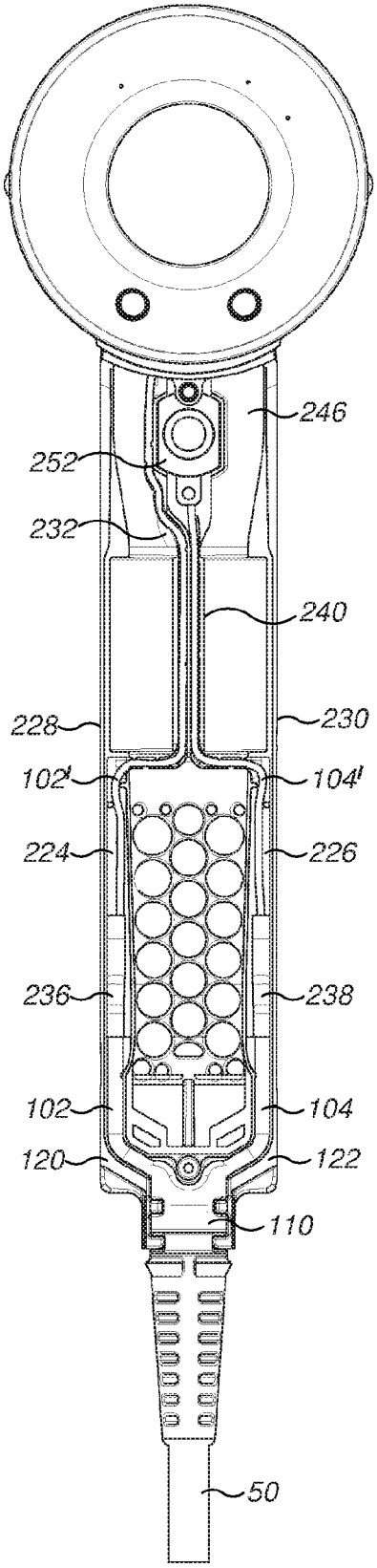
Figure 9A:
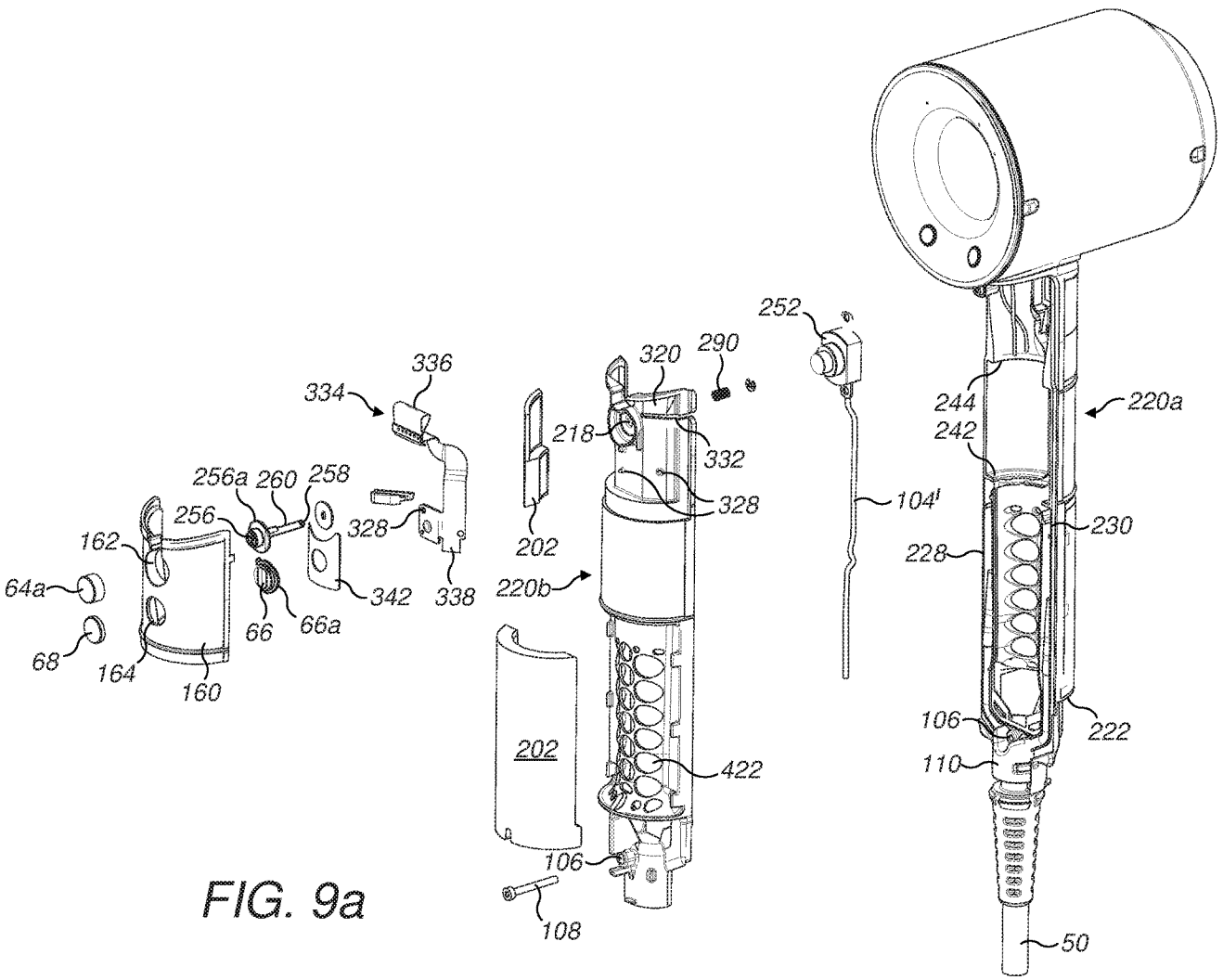
FIGS. 9*a* and 9*b* show different exploded views of an on/off switch.
Figure 9B:
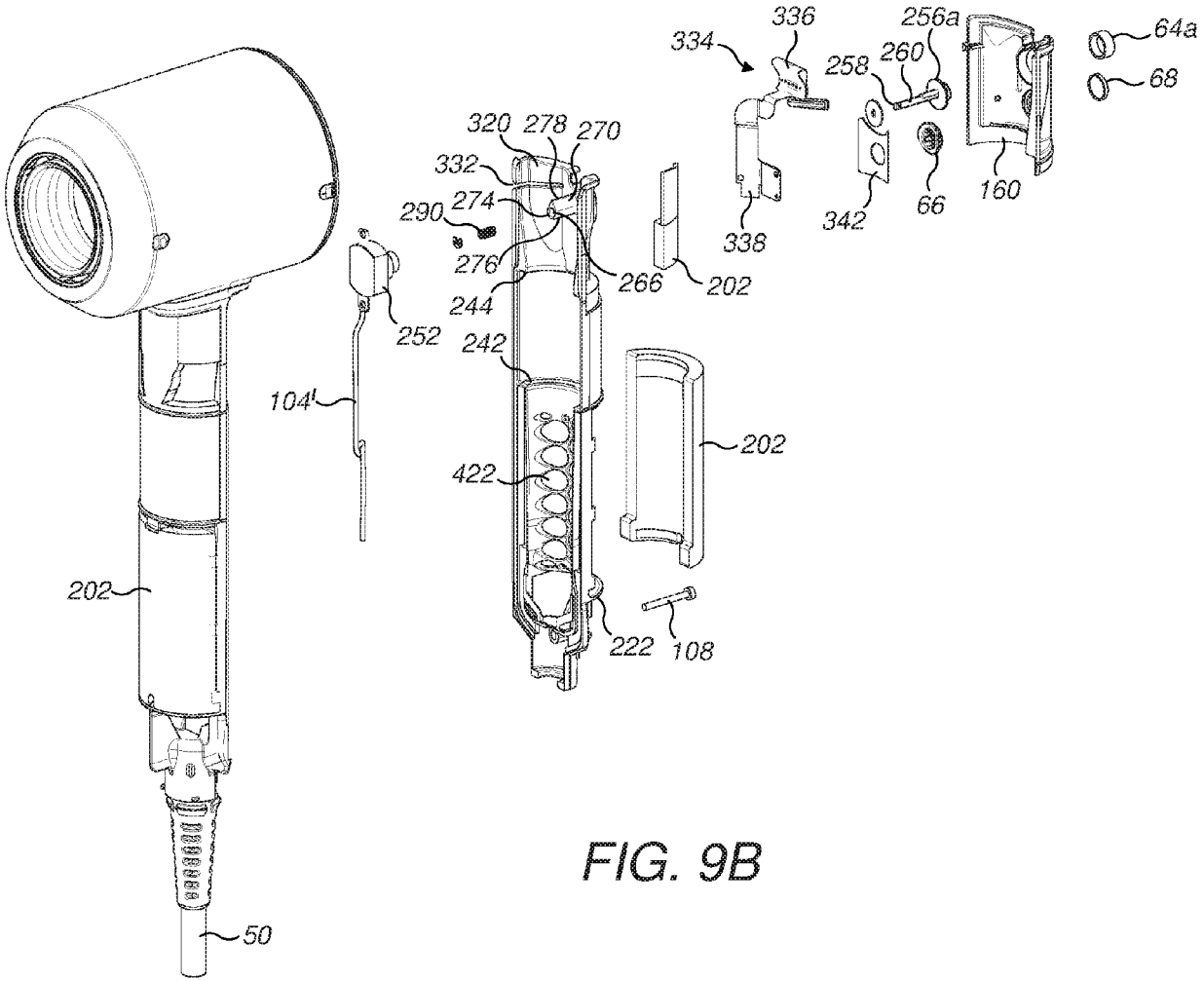

FIG. 1 shows a hairdryer 10 with a handle 20 and a body 30. The handle has a first end 22 which is connected to the body 30 and a second end 24 distal from the body 30 and which includes a primary inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The body 30 has a first end 32 and a second end 34 and can be considered to have two parts. A first part 36 which extends from the first end 32 which is tubular and of a generally consistent diameter and a second part 38 which extends from the second end 34 to join the first part 36. The second part 38 is cone shaped and varies in diameter along its length from the diameter of the first part 36 of the body 30 to a smaller diameter at the second end 34 of the body.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary inlet 40 in the handle 20 includes first apertures 42 that extend around and along the outer wall 200 of the handle and second apertures 46 that extend across and through the end wall 210 of the handle 20. The cable 50 is located approximately in the middle of the end wall 210 so extends from the centre of the handle 20. The end wall 210 is orthogonal to the outer wall 200 and inner wall 220 of the handle.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary inlet 40, a fan unit 70 is provided. The fan unit 70 includes a fan and a motor. The fan unit 70 draws fluid through the primary inlet 40 towards the body 30 through a fluid flow path 400 that extends from the primary inlet 40 and into the body 30 where the handle 20 and the body 30 are joined 90. The fluid flow path 400 continues through the body 30 towards the second end 34 of the body, through a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and a duct 310. The primary fluid flow path 400 extends along the body from the junction 90 of the handle 20 and the body 30 between the outer wall 360 and the duct 310 towards the primary fluid outlet 440 at the second end of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the duct 310 which is an inner wall of the body 30 and extends within and along the body. A fluid flow path 300 extends within the duct from the fluid inlet 320 to the fluid outlet 340.

The inner duct is formed from a cone or trumpet shaped portion 350 and a tubular part 312. At the first end 32 of the body 30, the cone portion 350 extends between the tubular part 312 and the outer wall 360. This cone portion 350 at least partially defines the fluid inlet 320. At the second end 34 of the body a gap 370 is provided between the outer wall 360 and the tubular part 312, this gap 370 defines the primary fluid outlet 440. The primary fluid outlet 440 is annular and surrounds the fluid flow path 300. The primary fluid outlet 440 may be internal so the primary fluid flow path 400 merges with the fluid flow path 300 within the body 30. Alternatively, the primary fluid outlet 440 is external and exits from the body 30 separately to the fluid from the fluid flow path 300 at the fluid outlet 340.

The duct 310 is an internal wall of the hairdryer that can be accessed from outside the hairdryer. Thus, the duct 310 is an external wall of the hairdryer. The duct 310 is recessed within the body 30 so the cone portion 350 that connects between the outer wall 360 and the tubular portion 312 of the duct 310 is angled with respect to the outer wall 360.

A PCB 75 including the control electronics for the hairdryer is located in the body 30 near the side wall 350 and fluid inlet 320. The PCB 75 is ring shaped and extends round the duct 310 between the duct 310 and the outer wall 360. The PCB 75 is in fluid communication with the primary fluid flow path 400. The PCB 75 extends about the fluid flow path 300 and is isolated from the fluid flow path 300 by the duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. Thus fluid that is processed by the fan unit and heater is augmented by the entrained flow.

As the space between the outer wall 360 and the duct 310 is utilised to position a heater 80 and the PCB 75 it is important that the space inbetween the outer wall 360 and the tubular portion 312 of the duct 310 is maintained along the length of the body 30. One reason for this is that hot spots could be formed around the outer wall 360 and/or the tubular portion 312 of the duct 310 if the spacing between each of these and the heater 80 were not substantially constant. Hot spots could lead to premature failure of components of the appliance. At the first end 32 of the body 30, the relative locations of the outer wall 360 and the duct 310 are fixed by a joint comprising interleaved fingers which extend from the outer wall 360 and the duct 310.

Referring now to FIGS. 2 to 4 and 7*b* in particular a device 100 for distributing wires 102, 104 has a central hub 110 which houses a cable 50 and a pair of arms 120, 122 which house the wires 102, 104 as they are routed from the central hub 110 towards an inner wall 220 of a handle 20 of an appliance 10.

The inner wall 220 has a greater diameter than the central hub 110 so the wires 102, 104 with the arms 120, 122 extend from the central hub 110 radially outwards towards the inner wall 220 forming a generally "Y" shaped device 100.

The inner wall 220 is shaped and perforated to reduce turbulence within the fluid flow path and to mitigate noise. The inner wall 220 has a downstream end 222 which curves from the outer wall 200 radially inwards to provide a space between the outer wall 200 and the inner wall 220 in which a lining material 202 is positioned. The lining material 202 along with the perforations 422 in the inner wall 220 absorb sounds and/or vibrations produced within the handle 20. The curve of the inner wall 220 at the downstream end 222 guides fluid from the fluid inlet 40 towards a narrower cross sectional area where the lining material 202 is located.

The device 100 has a central hub 110 which sits in the middle of the fluid flow to the inner wall 220 from the fluid inlet 40. The central hub 110 is spaced away from the downstream end 222 of the inner wall 200 to reduce the impact of the central hub 110 on fluid flowing within the fluid flow path 400. If the central hub 110 is closely spaced to the downstream end 222 of the inner wall 220 then noise is created along with turbulence within the flow.

In this example, the device 100 is formed from two parts 100*a*, 100*b* which each provide half of the central hub 110 and half of each of the two arms 120, 122. Thus, a cable 50 can be laid into one of the two parts 100*a* or 100*b* and the wires 102, 104 can be placed with respect one half of each arm 120, 122 subsequently, the other part of the device 100 is attached securing the cable 50 within the central hub 110 and the wires 102, 104 within their respective arms 120, 122.

In addition, the inner wall 220 is formed from two parts 220*a*, 220*b* and advantageously, the two parts 220*a*, 220*b* of the inner wall 220 correspond to and align with the two parts 110*a*, 100*b* of the device 100. Thus a first part 100*a* of the device 100 aligns with a first part 220*a* of the inner wall 220 and a second part 100*b* of the device aligns with a second part 220*b* of the inner wall 220. This simplifies assembly of the parts that are housed within the inner wall 220. For example parts such as the fan unit 70 may be placed within one of the two parts of the inner wall 220 when the cable 50 and wires 102, 104 are being placed into the corresponding one of the two parts of the device 100. When all the parts are aligned correctly, the two parts of the inner wall 200 and the device 100 may be joined together to form an inner handle 26 of the hairdryer 10.

The two parts 220*a*, 220*b* of the inner wall 220 are each a half cylinder that together form a central tube or inner handle 26 of the handle 10. In order that the two parts 100*a*, 100*b* of the device 100 align with or correspond to the half cylinders, the two parts 100*a*, 100*b* of the device 100 are also formed as equal halves and the two arms 120, 122 are formed diametrically spaced apart around the central hub 110.

The device 100 is formed so that each of the arms 120, 122 are substantially similar and could be used within the hairdryer 10 in either orientation that aligns with the two parts 220*a*, 220*b* of the inner wall 220.

The wires 102, 104 are housed within the arms 120, 122 which can be hollow shells but are alternatively solid with recesses adapted to accommodate a wire passing through the arm. Both recesses can be formed completely within one of the two parts 100*a*, 100*b* of the device, alternatively each of the two recesses can be split between the two parts 100*a*, 100*b* of the device 100.

The handle 20 has a fluid inlet 40 at one end 24 through which the cable 50 passes. As the cable 50 is located approximately centrally of the handle 20, the central hub 110 of the device 100 is also located centrally or in the middle of the handle 20. During use of the hairdryer 10, fluid flows through the fluid inlet 40 passed the device 100 and into the fluid flow path 400 defined by the inner wall 220.

The arms 120, 122 of the device 100 extend across the fluid flow path 400. To minimise any asymmetry in the flow the arms 120, 122 are symmetrical. To provide strength against tugging on the cable 50 the arms 120, 122 extend away from the fluid inlet 40 as the arms 120,122 move from the central hub 110 towards the inner wall 220. In other words, the arms 120, 122 extend towards a fluid outlet 440 of the fluid flow path 400. In addition, the arms 120, 122 are shaped to minimise flow disturbance. The arms 120,122 curve from a downstream end 124 to a maximum diameter and then taper towards an upstream end 126. The arms 120, 122 have a tapered back face. The arms could alternatively be formed from an aerofoil cross-section. The skilled person will appreciated that the object is to minimise flow separation and/or the generation of turbulence. In this embodiment, the device 100 additionally has a structural function and has four radially spaced apart support struts 112, 114, 116, 118. A pair of the support struts 114, 118 extends from the arms 120, 122 towards the fluid inlet 40; the other pair of support struts 112, 116 extends from the central hub 110 towards the outer wall 200 of the handle 20. The outer wall 200 of the handle 20 is a thin sleeve which is supported by the inner wall 220 from the body 30 to the distal end 222 of the inner wall 220 however, as the inner wall 220 does not extend over the fluid inlet 40, the outer wall 200 is unsupported along the length of the first set of apertures 42 that extend around and along the outer wall 200. The four support struts 112, 114, 116,118 extend radially out from the central hub 110 of the device 100 to contact the outer wall 200 and extend longitudinally from the distal end 222 of the inner wall 220 towards the end 24 of the handle 20.

The support struts 112, 114, 116, 118 are plate like and have rounded ends 128 to reduce the amount of material within the support struts and so minimise blocking of the first apertures 42 of the fluid inlet 40. The support struts 112, 114, 116, 118 increase the hoop strength of the handle 20 at and around the inlet 40 so if the hairdryer 10 is dropped, the support struts mitigate any damage that might occur. The support struts 112, 114, 116, 118 additionally protection the handle 20 from damage if the cable 50 is bent towards the handle 20.

In this example, the two parts 100*a*, 100*b* of the device 100 are secured together using a screw 108 which is inserted into screw hole 106. This has two main functions; firstly it prevents the wires 102, 104 becoming misplaced during manufacture and subsequent use and potentially being nipped between parts of the arms 120, 122; and secondly it forms part of a strain relief for the cable 50.

The cable 50 has an overmould 52 which surrounds the cable 50 both external of the handle 20 and within the handle 20. The central hub 110 of the device 100 includes an internal recess 54 which is adapted to accommodate the cable 50 and the over mould 52. The internal recess 54 includes a number of lugs 56, 58, 60 which extend radially inwardly of the central hub 110 into the internal recess 54. These lugs 56, 58, 60 engage with corresponding recesses 130 (See FIG. 1) in the overmould 54. When the two parts 100*a*, 100*b* of the device 100 are secured using a screw the overmould 54 and the cable 50 are securely attached within the handle 20 and if the cable 50 were tugged it is prevented from detaching from the handle 20.

The overmould 52 is formed of two parts a first part which is an internally located plastic overmould 52*a* and is positioned adjacent the end of the cable 50 where the wires 102, 104 protrude individually from the cable 50 and a rubber overmould 52*b* which extends over the plastic overmould 52*a* along the cable 50 external of the handle 20. A cable tie 48 is used to secure the different parts of the overmould 52 together.

Referring to FIGS. 7*a*, 8*a*, 8*b* and 9 in particular, the inner wall 220 includes a pair of recesses 224, 226 which in this example are located one along each edge 228, 230 of the first part 220*a* of the inner wall 220. The recesses 224, 226 house the wires 102, 104 that extend from the cable 50 to the PCB 75. Thus, the wires 102, 104 are protected from being snagged or caught and are safely out of the fluid flow path 400 where they would cause some disruption to the flow of fluid.

The cable 50 includes a live wire 104 and a neutral wire 102. The neutral wire 102 passes from the device for distributing wires 100 and into one of the recesses 226 and live wire 104 also passes from the device for distributing wires 100 and into a second recess 224. Within both recesses 224, 226 the wires 102, 104 from the cable are connected to the internal live wire 104' and internal neutral wire 102' of the appliance using spade connectors 236, 238.

The fan unit 70 is supported within the inner wall 220 by two annular seats which retain the motor longitudinally within the inner wall 220 and thus the handle 20. A first annular seat 242 is provided adjacent the upstream end of the fan unit 70 and a second annular seat 244 is provided adjacent the downstream end of the fan unit 70. The recesses 224, 226 could continue passed the fan unit 70, however in this embodiment, the recesses 224, 226 are discontinued where they meet the first annular seat 242. Both the internal neutral wire 102' and the internal live wire 104' are routed from their respective recesses 224, 226 radially around the inner wall 220*a* and then longitudinally along a pair of channels 240 formed within the inner wall 220*a*. The pair of channels 240 extends through the first annular seat 242 along the inner wall 220*a* and through the second annular seat 244. The pair of channels 240 is designed to receive the internal live wire 104' and the internal neutral wire 102' and hold those wires in place around the fan unit 70.

The downstream end 240*b* of the pair of channels 240 opens into a wire pocket 232 that extends from the second annular seat 244 to the electrical contacts 252 of the on/off switch 250. The wire pocket 232 is designed to accommodate slack in the internal live wire 104' and the internal neutral wire that results from construction of the appliance when the live wire 104 is connected to the internal live wire 104' via the spade connector 236 and the neutral wire 102 is connected to the internal neutral wire 102' via the spade connector 238.

Figure 10A:
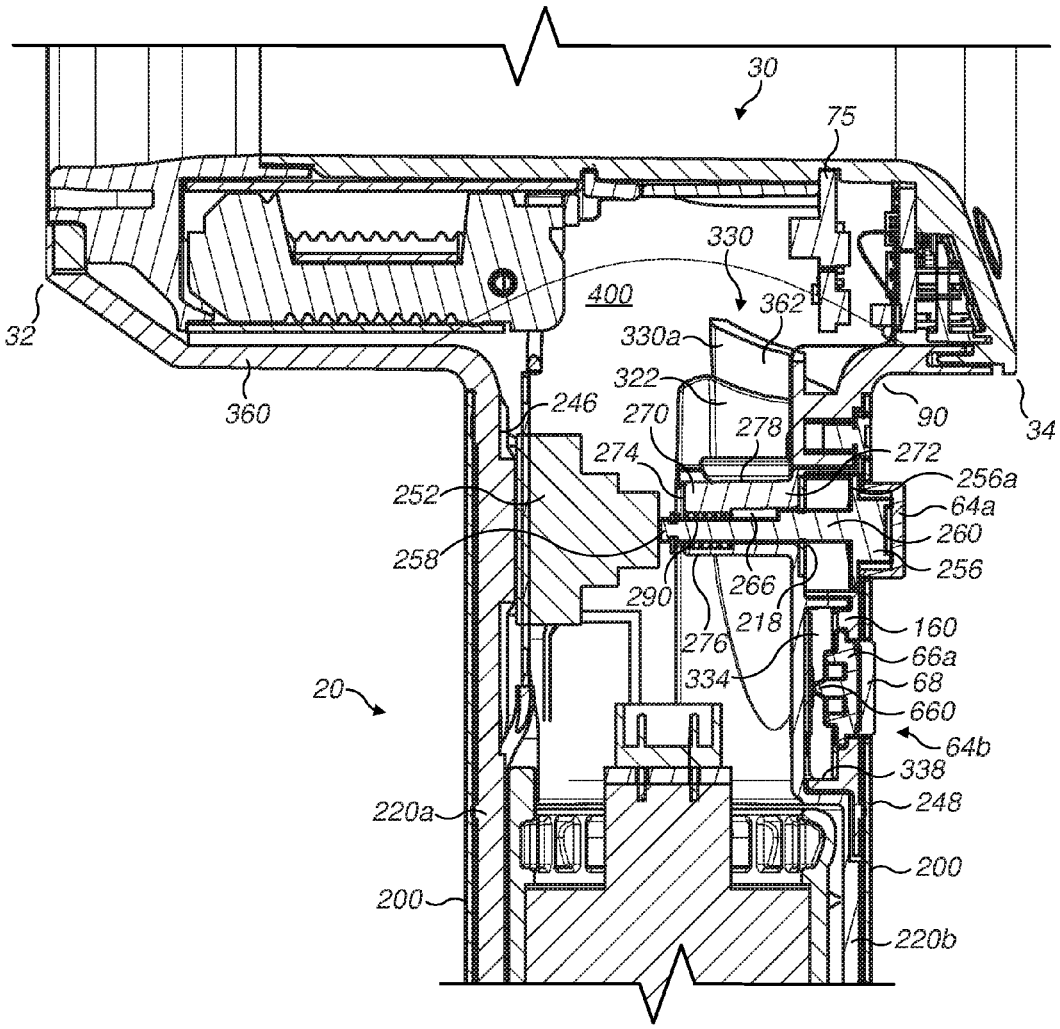
FIGS. 10*a* and 10*b* show different cross sectional views through an on/off switch.
Figure 10B:
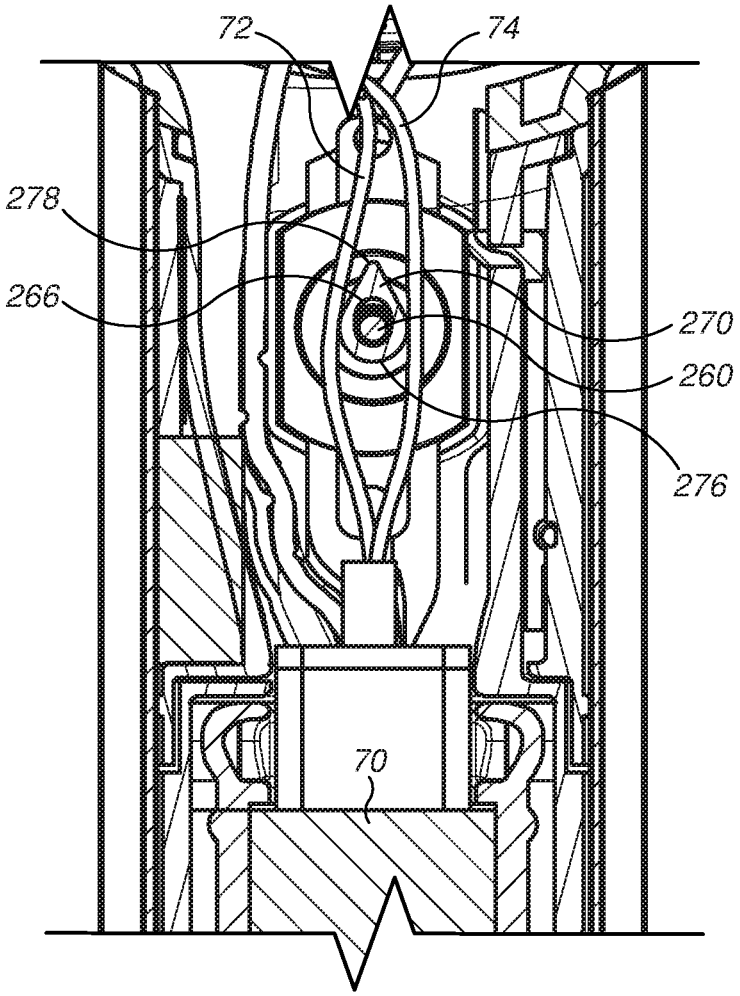
Figure 11A:
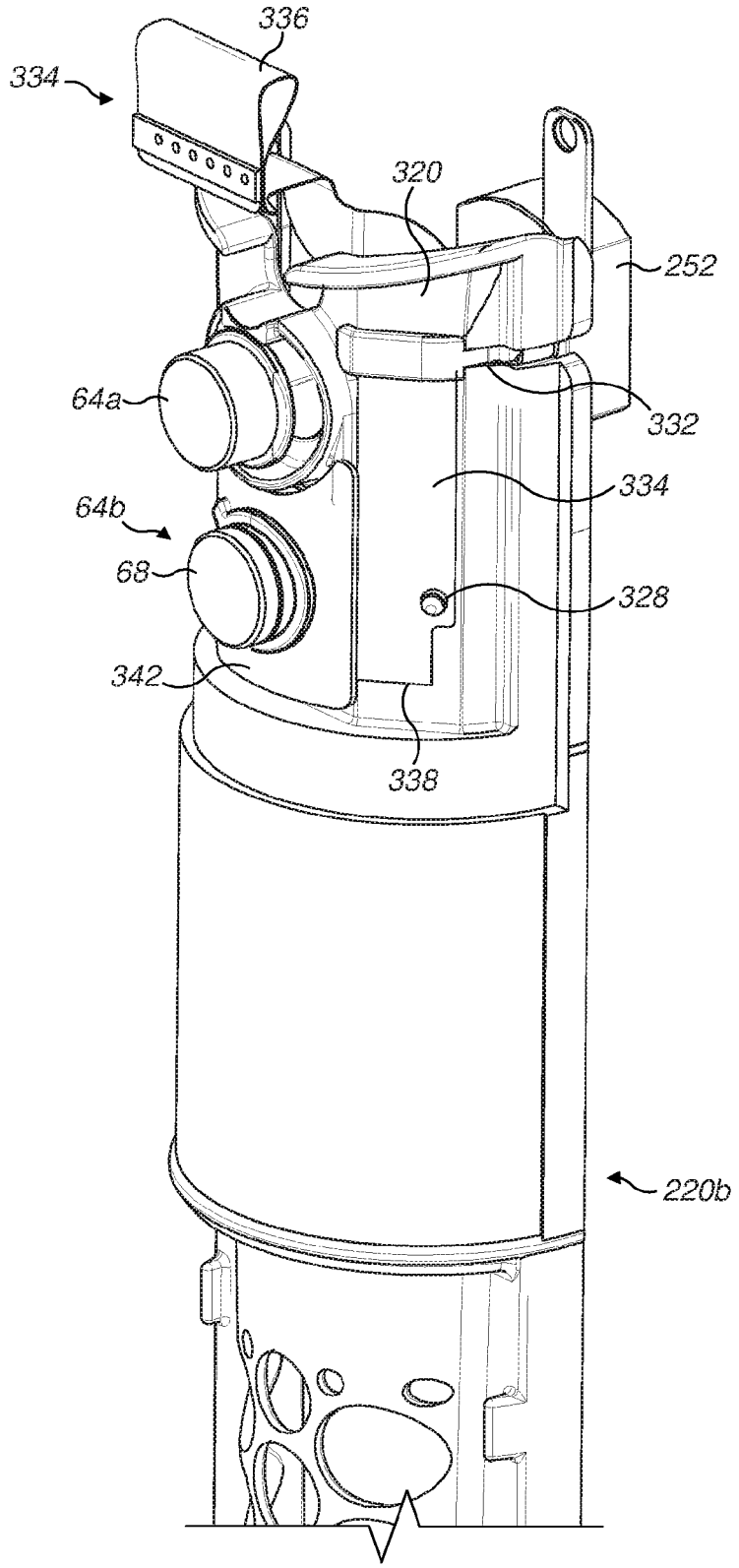
FIGS. 11*a* and 11*b* show rear and front isometric projections of an on/off switch.
Figure 11B:
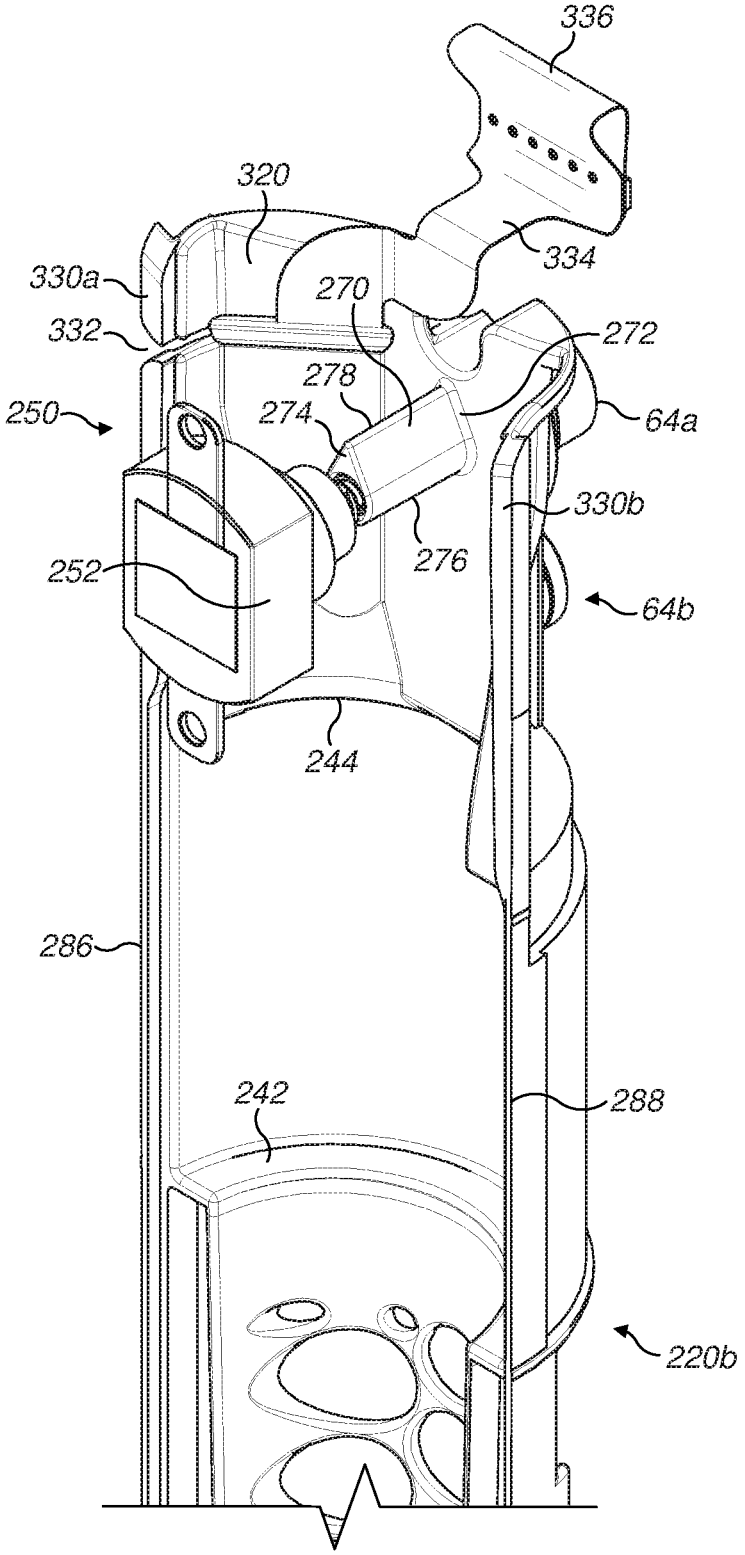

The internal live wire 104' is connected from the electrical contacts 252 of the on/off switch 250 to the heater 80 via safety switches and fuses (not shown) to the PCB and the internal neutral wire 102' is directed connected to the PCB 75 to complete the circuit. The motor of the fan unit is electrically connected to the PCB 75 via wires 72, 74 (FIG. 1; FIG. 10*b*).

Referring in particular to FIGS. 8*a* to 11*b* the on/off switch 250 includes a button 64*a* which a user depresses to turn the hairdryer 10 on or off, electrical contacts 252 and a push rod 260 which physically connects the button 64*a* to the electrical contacts 252. The push rod 260 has a first end 256 which engages with the user operable button 64*a* and a distal end 258 which engages with electrical contacts 252. Thus when a user depresses the button 64*a*, the push rod 260 is pushed against the electrical contacts 252 causing the hairdryer 10 to be turned on or off. The button 64*a* is mounted to the external surface 248 of the outer wall 200 of the handle 20. The electrical contacts 252 are mounted diametrically opposite the button 64*a* on an internal surface 246 of the inner wall 220 of the handle 20. The push rod 260 extends across the inside of the handle 20 and across the fluid flow path 400 that flows through the handle 20.

In order to maintain the relative locations of the push rod 260 and the electrical contacts 252, a guide rod 270 is provided. The guide rod 270 has a first end 272 which is attached to the inner wall 220 and a second end 274 distal from the first end 272. The push rod 260 is generally cylindrical and extends through an aperture 266 that extends through the guide rod 270.

The guide rod 270 surrounds or extends around the push rod 260, supporting the push rod 260 and maintaining the location of the push rod 260 with respect to the button 64*a* and the electrical contacts 252. The guide rod 270 is generally tear shaped having an upstream end 276 which is rounded and a downstream end 278 which is pointed. The resulting cross section has a circular upstream end and a triangular downstream end.

A return spring 290 is provided between the electrical contacts 252 and the push rod 260 to give positive positioning of the button 64*a* denoting the on and off locations of the electrical contacts 252.

The fluid flow path 400 is non-linear, in the handle 20 the fluid flow path 400 flows in a first direction and in the body 30, the fluid flow path 400 flows in a second direction. At the junction 90 between the handle 20 and the body 30, a baffle 330 (FIG. 10*a*) is provided; the baffle 330 has two main functions. A first function is to reduce noise and a second function is to provide a route for a digital connection from the PCB 75 to a second button 64*b* on the handle 20.

Fluid flows in the fluid flow path 400 along the inside of the handle 20 from the fluid inlet 40. At the junction 90 between the handle 20 and the body 30 the fluid flow path 400 turns by around 90°. Due to the location of the PCB 75, fluid flowing in the fluid flow path 400 would tend to interact with the PCB causing turbulence and noise. A baffle 330 is provided to at least partially block the fluid from dispersing towards the first end 32 and directly interacting with the PCB 75.

In addition, the PCB 75 is housed within space formed in the body 30 between the duct 310 and the outer wall 360 adjacent the first end 32 of the body 30. The baffle 330 additionally at least partially blocks fluid flowing directly onto the PCB 75 from the handle 20.

The baffle 330 is arcuate and curves to mimic the curvature of the inner wall 220 of the handle 20 extending up from the switch 250 partially into the body 30. The baffle 330, in this embodiment has outer edges 330*a*, 330*b* which are approximately aligned to the longitudinal edges 286, 288 of the second part 220*b* of the inner wall 220. The baffle 330 is formed from two parts a handle part 322 and a body part 362. The handle part 332 is moulded with the second part 220*b* of the inner wall 220 and extends the second part 220*b* towards the body 30. The body part 362 is moulded with the outer wall 360 of the body 30 and extends the baffle further into a space within the body 30.

The baffle 330 includes a slot 332 which is provided in the handle part 332 to route a digital connection in the form of a flexi extension 334 between the PCB 75 and button 64*b*. Whereas the on/off button 64*a* is a part of an analogue switch, such a switch is unnecessary for button 64*b* which for example changes a control setting or provides a cool shot function. The flexi extension 334 connects to the PCB 75 at a first end 336, folds around the junction 90 between the handle 20 and the body 30 on the fluid flow side of the baffle 330 thus the flexi extension 334 is within the fluid flow path 400, then through the slot 332 formed in the handle part 322 of the baffle 330 to the button 64*b* towards a second end 338. Between the slot 332 and the second end 338 of the flexi extension 334, the flexi extension 334 lies between the inner wall 220 and the outer wall 200 of the handle 20.

Connection pips 328 are provided upstanding from the inner wall 220 to locate the flexi extension 332 towards the second end 338 around the button 64*b*. A seal member 342 is provided between the button 64*b* and the flexi extension 334 to prevent any leakage of fluid from the fluid flow path 400 around the button 64*b*.

The button 64*b* has two parts, a first part 68 is a user pressed cap that protrudes slightly from the handle 20 and a second part 66 which includes an electrical contact 660. When the first part 68 is pressed by a user, the second part 66 is pushed towards the flexi extension 334 and the electrical contact 660 that extends from the second part 66 makes an electrical connection with the flexi extension 334.

In order to provide additional support to the buttons 64*a*, 64*b* and their associated parts, a middle wall panel 160 is provided and it is located between the inner wall 220*b* and the outer wall 200 of the handle around the buttons 64*a*, 64*b*. The middle wall panel 160 is adapted to retain the push rod 260 and the second part 66 of button 64*b* within the handle 20. The middle wall panel 160 includes a first aperture 162 through which the first end 256 of the push rod 260 protrudes. A flange 256*a* extends around the first end 256 of the push rod 260 and the flange 256*a* has a larger diameter than the first aperture 162. The flange 256*a* thus retains the push rod 260 within the middle wall panel 160.

The inner wall 220*b* includes an aperture 218 through which the distal end 258 of the push rod 260 can pass but not the first end 256. When the button 64*a* is pushed, the first end 256 of the push rod 260 is pushed radially inwards but the extent of the radial movement is limited by the aperture 218 in the inner wall 220*b*. The aperture 218 and the flange 256*a* prevent the first end 256 from moving radially beyond a predetermined amount. This provides protection against excessive force being applied to the electrical contacts and provides support for the push rod 260.

The middle wall panel 160 has a second aperture 164 through which the second part 66 of the button 64*b* protrudes. The second part 66 of the button 64*b* also has a flange 66*a* that extends around the second part 66 and has a larger diameter than the second aperture 164 thus retaining the second part 66 of the button 64*b* in position between the middle wall panel 160 and the flexi extension 334. The inner wall 220*b* retains the flexi extension 334 in position by location pips 328.

The arms 120, 122 of the device 100 and/or the recesses 226, 228 preferably encapsulate their respective contained wires to electrically isolate them from the fluid flow path.

The outer wall 360 of the body 30 and the inner wall 220 of the handle 20 are preferably moulded from a plastic material. Suitable plastic materials include polycarbonate, glass-filled PPA (Polyphthalamide), PPS (Polyphenylene Sulphide), LCAP (Liquid Crystal Aromatic Polymer) or PEEK (Polyether ether ketone) and the skilled person will appreciate that this list is not exhaustive and that other materials could be used with alternative manufacturing methods. The outer wall 200 of the handle 20 can be made from any of a number of suitable materials but is preferably made from aluminium, an alloy of aluminium a steel or a stainless steel.

The device 100 and the inner wall 200 of the handle 20 may be moulded integrally. The outer wall 360 of the body 30, the first part 220*a* of the inner wall and the first part 100*a* of the device are preferably moulded as a first piece with the second part 220*b* of the inner wall 200 and the second part 100*b* of the device 100 being preferably moulded as a second piece of the appliance. The baffle 330 need not be moulded as two parts; alternatively it is moulded integrally with either the first or the second piece of the appliance.

Referring now to FIGS. 12*a*, 12*b*, 12*c*, 14, 15*a* and 15*b* in particular, the joint between the outer wall 360 and the duct 310 will now be described in detail. The outer wall 360 has an outer surface 360*a*, an inner surface 360*b* separated by the thickness t of the outer wall. Towards the upstream end or the first end 32 of the body 30 the outer wall 360 comprises a first pair of fingers 1362, 1364 which extend axially from the outer wall 360 along the length of the body 30. Each of the first pair of fingers 1362, 1364 is formed within the thickness t of the outer wall 360. In this example both of the first pair of fingers 1362, 1364 extend continuously around the circumference of the outer wall 360.

The first pair of fingers 1362, 1364 has an external finger 1362 and an internal finger 1364. The external finger 1362 has an outer surface 362*a* and an inner surface 362*b* separated by the thickness of the finger t1. The outer surface 362*a* of the external finger 1362 forms part of the external surface 360*a* of the outer wall 360. The internal finger 1364 has an inner surface 364*b* and a radially outer surface 364*a* separated by the thickness t2 of the internal finger 1364. The inner surface 364*b* of the internal finger 1364 forms part of the internal surface 360*b* of the outer wall 360.

The first pair of fingers 1362, 1364 forms a first part of a joint between the outer wall 360 and the duct 310.

The duct 310 has a tubular part 312 and a cone or trumpet shaped portion 350. The tubular part 312 extends within the outer wall 360 and the cone portion 350 extends between the outer wall 360 and the tubular part 312 defining the further fluid inlet 320 into the appliance and sealing the fluid flow path 400 within the body 30. The cone portion 350 is obliquely angled so the tubular part 312 of the duct 310 is recessed within the body 30.

A second pair of fingers 352, 354 extends from the cone portion 350. The second pair of fingers 352, 354 is adapted to interleave with the first pair of fingers 1362, 1364 providing a connection or joint between the outer wall 360 and the inner bore 310 at the first end 32 of the body 30.

Figure 12:
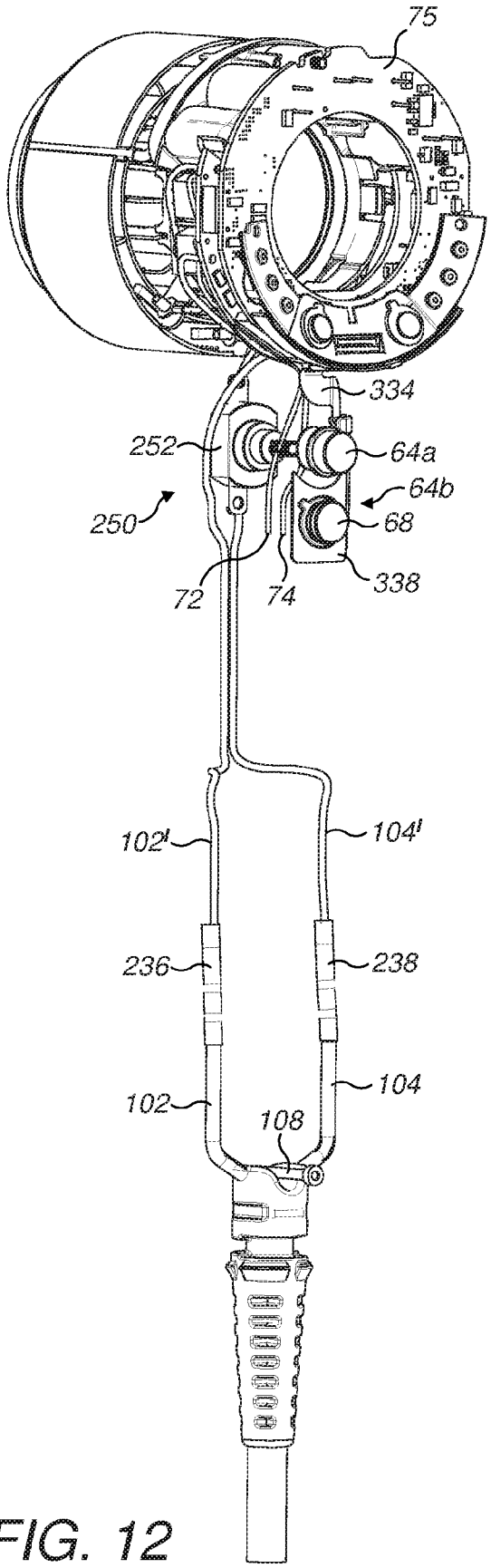
FIG. 12 shows internal details of part of a handle of an appliance.
Figure 13A:
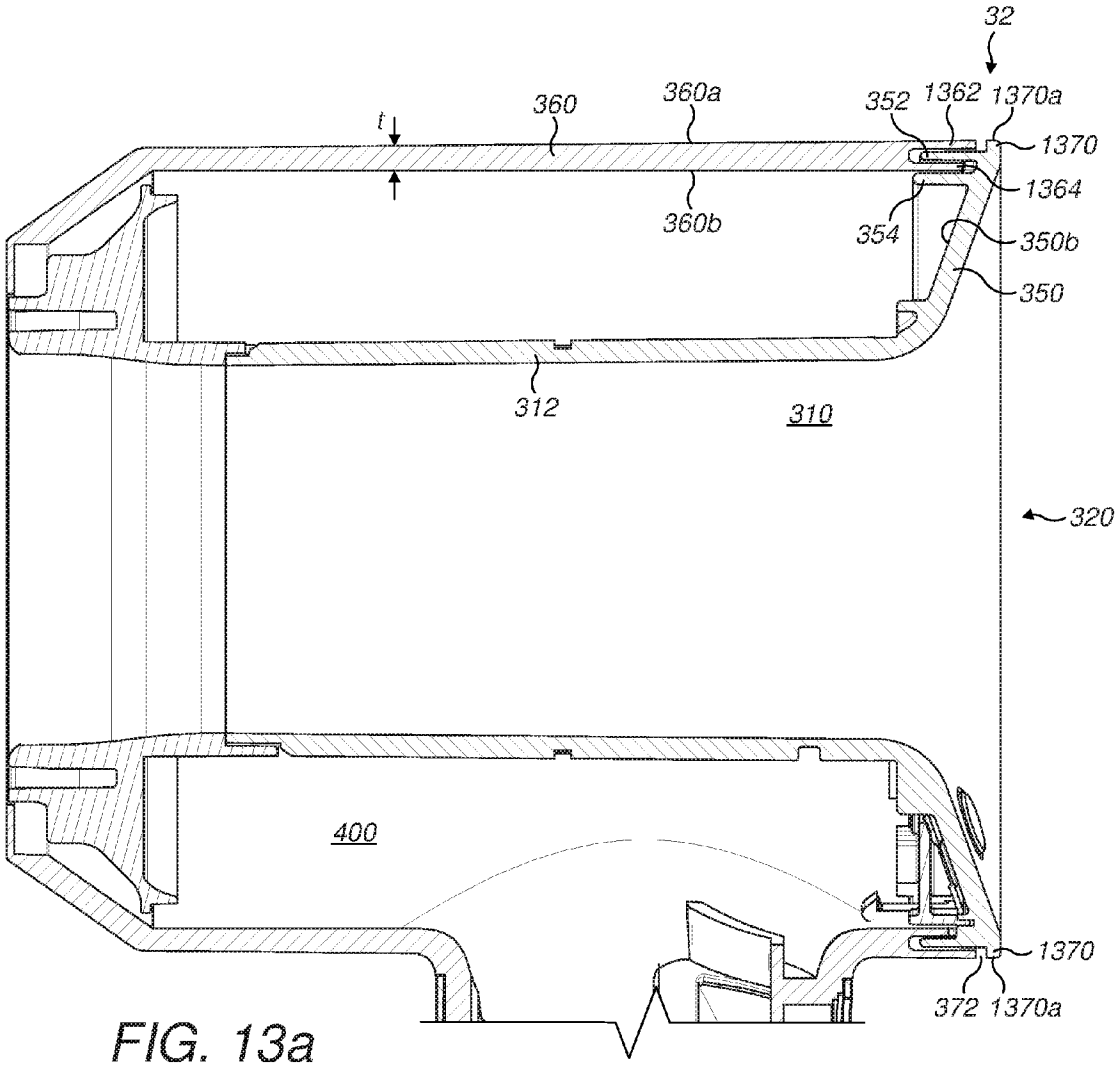
FIG. 13*a* shows a cross section through a part of the body of the appliance of FIG. 1.
Figure 13B:
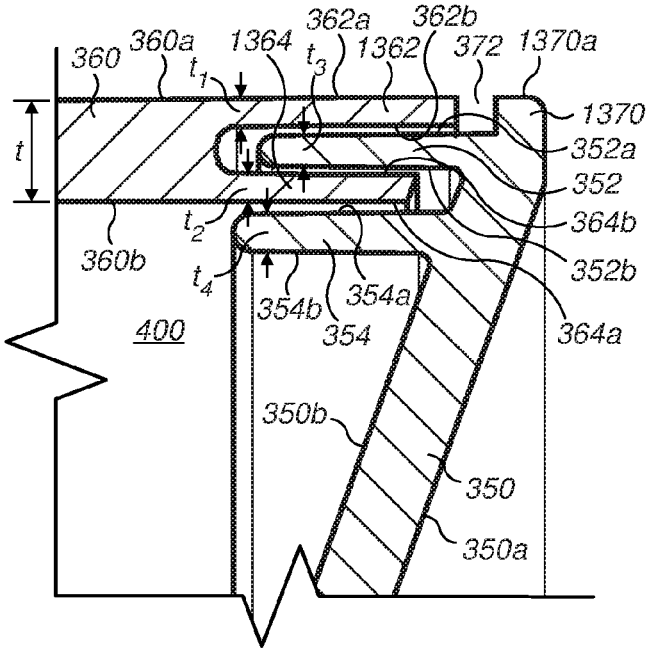
FIGS. 13*b* and 13*c* show enlarged views of part of the cross section of FIG. 2*a*.
Figure 13C:
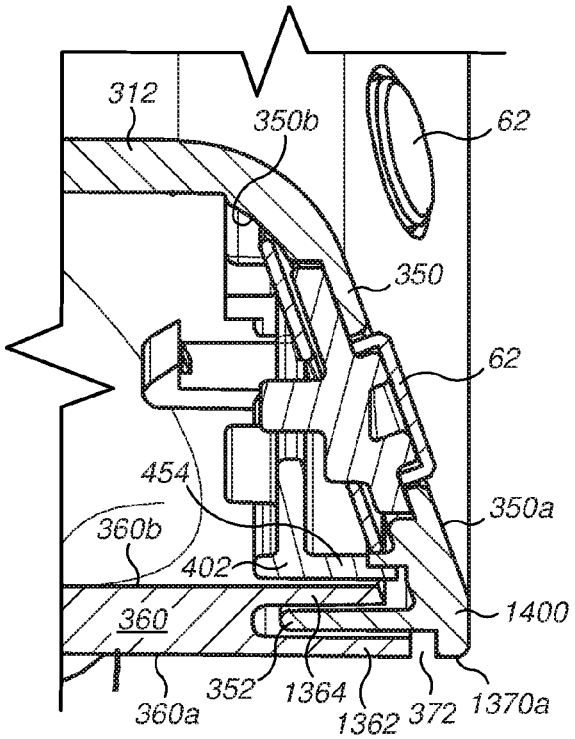
Figure 14:
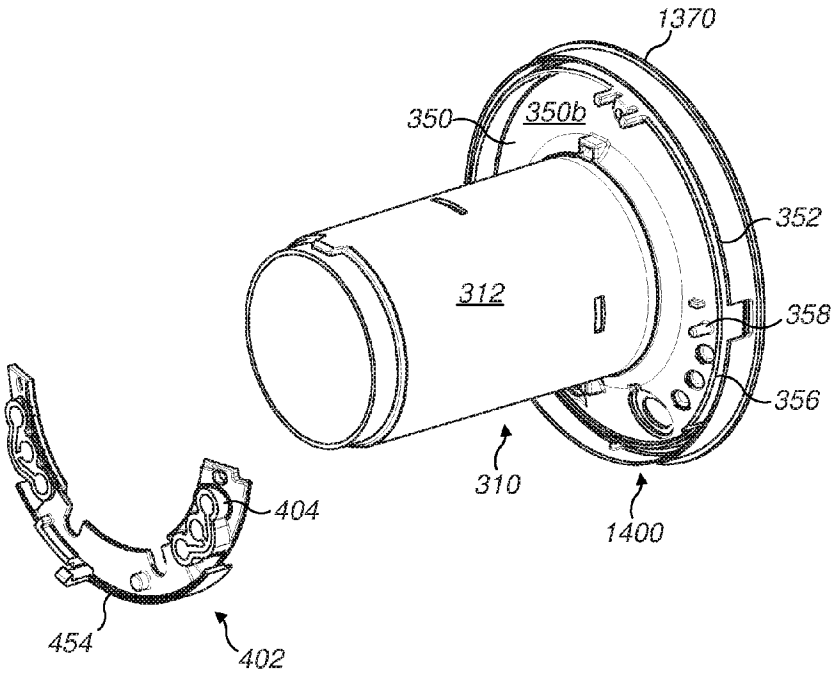
FIG. 14 shows an exploded view of some parts of the body of the appliance shown in FIG. 1.
Figure 14:
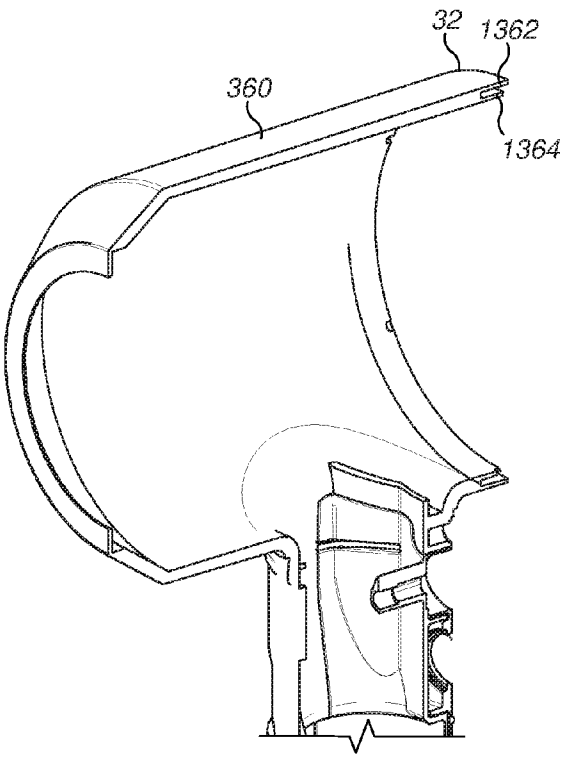
Figure 15B:
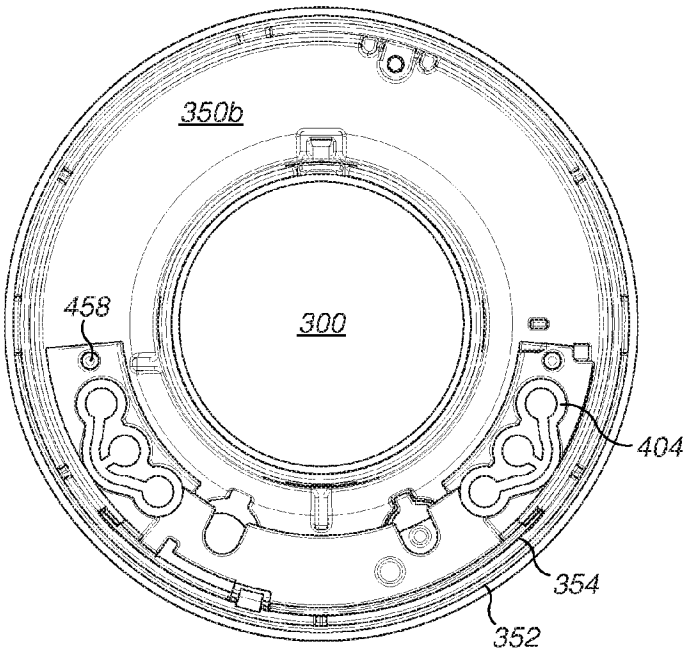
FIGS. 15*a* and 15*b* show different orientations of a duct of an appliance.
Figure 15A:
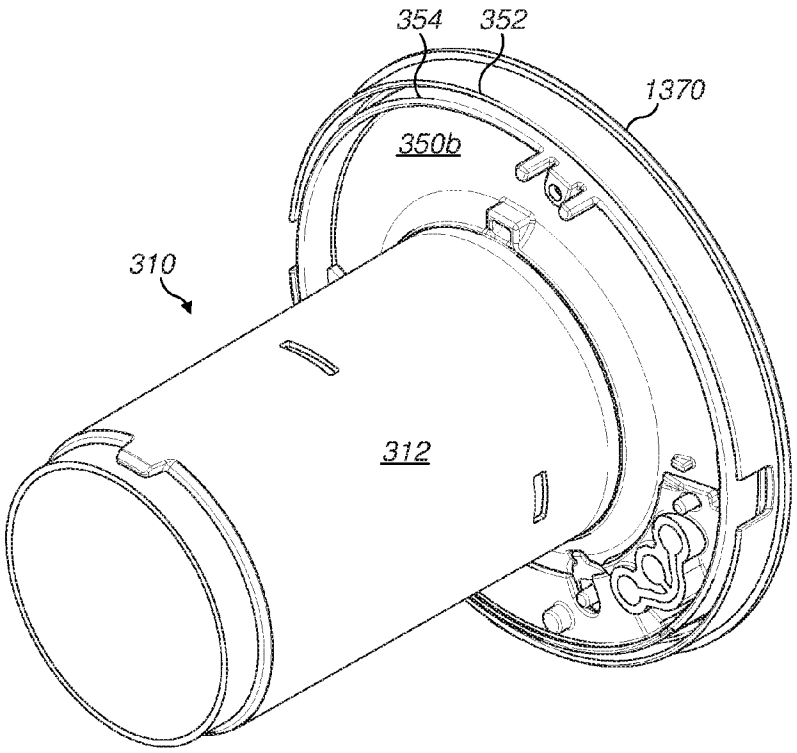

The outer wall 360 and the tubular part 312 of the inner bore 310 are approximately concentric and the longitudinal axes of the outer wall 360 and the tubular part 312 are approximately parallel. The second pair of fingers 352, 354 extends from an inner surface 350*b* of the cone portion 350 towards the tubular part 312 and is generally parallel to the tubular part 312. Thus, when the tubular portion 312 of the duct 310 is inserted into the outer wall 360 the second pair of fingers 352, 354 will interleave and interlock with the first pair of fingers 1362, 1364 (FIGS. 12*a*, 12*b* and 12*c*).

The second pair of fingers 352, 354 will now be explained in more detail; there is an inner finger 354 and a radially outer finger 352. The radially outer finger 352 is sandwiched between or retained between the external finger 1362 and internal finger 1364. The radially outer finger 352 has an outer surface 352*a* and an inner surface 352*b* separated by a thickness t3. When the joint between the first and second pair of fingers is made, the outer surface 352*a* of the radially outer finger 352 lies adjacent the inner surface 362*b* of the external finger 1362 of the first pair of fingers and the inner surface 352*b* of the radially outer finger 352 lies adjacent to the radially outer surface 364*a* of the internal finger 1364 of the first pair of fingers.

The inner finger 354 of the second pair of fingers has an inner surface 354*b* and a radially outer surface 354*a* separated by a thickness t4. When the joint between the two pairs of fingers is made, the internal finger 1364 of the first pair of fingers is sandwiched between of interleaved between the inner finger 354 and the radially outer finger 352 of the second pair of fingers. Thus, the radially outer surface 354*a* of the inner finger 352 and the inner surface 352*b* of the radially outer finger 352 lie adjacent the inner surface 364*b* of the internal finger 1364 and the radially outer surface 364*a* of the internal finger 1364 respectively.

In the example described, each of the fingers of the first pair of fingers 1362, 1364 and the second pair of fingers 352, 354 are approximately the same thickness. This reduces the chance of a weak link in one of the fingers involved in the joint. Thus t1, t2, t3 and t4 are all substantially equal.

The first pair of fingers 1362, 1364 is continuous around the outer wall 360 of the body 30. The second pair of fingers 352, 354 is also continuous around the cone portion 350 of the duct 310.

In this example, the cone portion 350 includes some control buttons 62 which are accessed by a user from the outer face 350*b* of the cone portion 350. The control buttons 62 are used to change flow and temperature settings of the appliance for example. In order to facilitate manufacture of the parts of the appliance around the buttons 62, the cone portion 350 is made in two parts. A first part 1400 includes the duct 312, the radially outer finger 352, a first portion 356 of the inner finger 354 and the outer surface 350*a* of the cone portion 350. A second part 402 is an arcuate section that provides supports for features of the buttons 62, housings for light guides 404 that provide a visual indication of the current setting of the control buttons 62 and a second portion 454 of the inner finger 354. When the first part 1400 and the second part 404 of the cone portion 350 are combined, the first portion 356 and the second portion 454 of the inner finger 354 are united to form a continuous ring around the cone portion 350.

The first part 1400 and the second part 402 of the cone portion 350 can be joined by any one of a number of ways including gluing, welding etc. In this example, once the second part 402 has been attached to the first part 1400, heat stakes 358 which are initially used help correctly locate the second part 402 with respect to the first part 1400 are melted fixing the relative location of the first part 1400 and the second part 402 of the cone portion 350.

The cone portion 350 and the outer wall 360 of the body 30 can be push fit together, however it is preferred that the joint between the outer wall 30 and the duct 310 is additionally glued to prevent accidental access to any of the internal parts of the appliance such as the PCB 75 or the heater 80. The glue can be applied to specific surfaces of the joint for example 352*b* and 364*a* or/and a reservoir of glue can be provided between either or both of the first pair of fingers 1362, 1364 and the second pair of fingers 352, 354 which is spread along joint faces during assembly of the joint when the duct 310 is pushed into the outer body 30. It is preferred that the amount of glue is sufficient to provide an adequate strength of joint but not enough that glue purges either internally within the body 30 or externally around the external finger 1362 of the first pair of fingers.

The cone portion 350 of the duct 310 is provided with a horn 1370. The horn 1370 is essentially a continuation of the cone portion 350 radially outwards beyond the second pair of fingers 352, 354. The horn 1370 forms an upstanding rim around the cone portion 350 that extends radially out farther than the radially outer finger 352. When the duct 310 is inserted into the body 30 an outer face 1370*a* of the horn 1370 aligns with the outer surface 360*a* of the outer wall 360 of the body 30 and the outer surface 362*a* of the external finger 1362 providing a continuation of the outer wall 360 of the body 30. A gap 372 may be provided between the horn 1370 and the external finger 1362 to absorb any small deviations in size of the body 30 and duct 310.

The outer wall 360 and the duct 300 are preferably moulded from a plastic material. Suitable plastic materials include polycarbonate, glass-filled PPA (Polyphthalamide), PPS (Polyphenylene Sulphide), LCAP (Liquid Crystal Aromatic Polymer) or PEEK (Polyether ether ketone) and the skilled person will appreciate that this list is not exhaustive and that other materials could be used with alternative manufacturing methods. The outer wall 200 of the handle 20 can be made from any of a number of suitable materials but is preferably made from aluminium, an alloy of aluminium a steel or a stainless steel.

In the embodiments described, the motor and fan were located within the handle of the appliance, this is not essential. The duct 300 need not provide a further fluid flow path, the cone portion 350 could extend across the whole of the area described by the outer wall 360 and the duct 300 could be used to house a fan unit.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hair care appliance comprising: a body having a first end and a second end that is opposite the first end, a handle comprising a wall that extends in a longitudinal direction of the handle, a fluid flow path flowing from a fluid inlet into the handle to a fluid outlet from the second end of the body, and a baffle, wherein the fluid flow path is non-linear, the baffle directs flow within the non-linear fluid flow path between the handle and the body, and the baffle extends in the longitudinal direction from an end of the wall forming a partial continuation of the wall to at least partially block fluid in the fluid flow path from flowing toward the first end of the body.

2. The appliance of claim 1, wherein the fluid flow path flows in a first direction within the handle and a second direction within the body.

3. The appliance of claim 1, wherein the wall defines the fluid flow path within the handle.

4. The appliance of claim 1, wherein the body and the handle are moulded as a first part and a second part.

5. The appliance of claim 4, wherein the body comprises an outer wall and each of the outer wall of the body and the wall of the handle at least partially define the fluid flow path from the fluid inlet to the fluid outlet.

6. The appliance of claim 5, wherein the first part of the appliance comprises a first portion of the wall of the handle.

7. The appliance of claim 6, wherein the second part of the appliance comprises the outer wall of the body and a second portion of the wall of the handle.

8. The appliance of claim 7, wherein when the first part and the second part are assembled a complete handle wall is produced.

9. The appliance of claim 5, wherein the handle wall is located upstream of the fluid inlet.

10. The appliance of claim 5, wherein the handle comprises an outer wall that surrounds the wall and includes the fluid inlet.

11. The appliance of claim 1, wherein the fluid flow path in the body is substantially orthogonal to the fluid flow path in the handle.

12. The appliance of claim 11, wherein first end of the body is an upstream end and the second end of the body is a downstream end.

13. The appliance of claim 12, wherein the handle is located towards the upstream end of the body.

14. The appliance of claim 13, wherein a printed circuit board (PCB) is provided within the body between the handle and the upstream end of the body.

15. A hand held appliance comprising: a body having a first end and a second end that is opposite the first end, a handle comprising a wall that extends in a longitudinal direction of the handle, a fluid flow path flowing from a fluid inlet into the handle to a fluid outlet from the second end of the body, and a baffle, wherein the fluid flow path is non-linear, the baffle directs flow within the fluid flow path, and the baffle extends in the longitudinal direction from an end of the wall forming a partial continuation of the wall to at least partially block fluid in the fluid flow path from flowing toward the first end of the body.

* * * * *